US011350759B1

(12) United States Patent
Schott et al.

(10) Patent No.: US 11,350,759 B1
(45) Date of Patent: Jun. 7, 2022

(54) BED SHEET/BED COVERING SECURING DEVICE AND METHOD

(71) Applicant: CANNELLA, LLC, Mandeville, LA (US)

(72) Inventors: Judy Cannella Schott, Mandeville, LA (US); Nita F. Gassen, New Orleans, LA (US)

(73) Assignee: CANNELLA, LLC, Mandeville, LA (US)

( * ) Notice: Subject to any disclaimer, the term of this patent is extended or adjusted under 35 U.S.C. 154(b) by 204 days.

(21) Appl. No.: 16/396,548

(22) Filed: Apr. 26, 2019

Related U.S. Application Data

(60) Provisional application No. 62/732,257, filed on Sep. 17, 2018, provisional application No. 62/720,914, filed on Aug. 21, 2018, provisional application No. 62/697,711, filed on Jul. 13, 2018, provisional application No. 62/663,136, filed on Apr. 26, 2018.

(51) Int. Cl.
*A47C 21/02* (2006.01)
*A47G 9/04* (2006.01)

(52) U.S. Cl.
CPC ..... *A47C 21/022* (2013.01); *A47G 9/04* (2013.01)

(58) Field of Classification Search
CPC ..... A47C 21/022; A47C 21/02; A47C 21/028; A47G 9/04; A47G 2009/0269; A47G 9/0261; A47G 9/0246
See application file for complete search history.

(56) References Cited

U.S. PATENT DOCUMENTS

| | | | |
|---|---|---|---|
| 170,573 | A | 11/1875 | Lesh |
| 267,498 | A | 11/1882 | Cox |
| 728,204 | A | 5/1903 | Coffman |
| 1,833,298 | A | 11/1931 | Oakey |
| 1,982,998 | A | 12/1934 | Matchett |
| 2,284,778 | A | 6/1942 | Treiber |
| 2,860,352 | A | 11/1958 | Pierre |
| 2,924,833 | A | 2/1960 | Klogether |
| 2,931,084 | A | 4/1960 | De Witt |
| 3,092,848 | A | 6/1963 | Gronvold |
| 4,662,016 | A | 5/1987 | Seeman |

(Continued)

FOREIGN PATENT DOCUMENTS

DE 2442451 3/1976

*Primary Examiner* — David R Hare
*Assistant Examiner* — George Sun
(74) *Attorney, Agent, or Firm* — Garvey, Smith & Nehrbass, Patent Attorneys, L.L.C.; Vanessa M. D'Souza; Charles C. Garvey, Jr.

(57) ABSTRACT

The present invention includes a device for securing bed sheets on a mattress having a bottom, a top surface, and a periphery including side and end walls, the device including a sleeve or band having side panels, end panels corner panels and a top edge, the sleeve or band can be fitted around the mattress periphery side and end walls. A securing, gripping, or positioning element, e.g., elastic or other suitable securing element, can be provided at one or more locations on the sleeve or band, wherein the securing, gripping, or positioning element(s) can be placed around the mattress periphery at a position below the mattress top surface. The securing, gripping, or positioning element(s) are capable of securing the bed sheets in between the sleeve or band and the mattress.

25 Claims, 12 Drawing Sheets

(56) References Cited

U.S. PATENT DOCUMENTS

| | | | | |
|---|---|---|---|---|
| 4,809,375 | A | 3/1989 | Bull | |
| 4,829,617 | A | 5/1989 | Dameron | |
| 4,891,856 | A | 1/1990 | Thornhill | |
| 5,148,560 | A | 9/1992 | Torres | |
| 5,218,729 | A | 6/1993 | Walton | |
| 6,457,194 | B1 | 10/2002 | Bennett | |
| 6,601,250 | B1 | 8/2003 | Taylor | |
| D637,858 | S | 5/2011 | Overstreet et al. | |
| 8,464,377 | B1 | 6/2013 | Carson et al. | |
| 8,707,482 | B1 | 4/2014 | Ramthun | |
| 10,016,078 | B1 * | 7/2018 | McDermott | A47G 9/0238 |
| 10,561,257 | B2 * | 2/2020 | Young-Loaeza | A47G 9/0246 |
| 2004/0060113 | A1 | 4/2004 | Lantagne | |
| 2008/0078029 | A1 * | 4/2008 | Seago | A47G 9/0246 5/499 |
| 2009/0172881 | A1 | 7/2009 | Peterson | |
| 2010/0162486 | A1 | 7/2010 | Joyce | |
| 2012/0233777 | A1 | 9/2012 | Hare | |
| 2014/0068868 | A1 * | 3/2014 | Morzano | A47G 9/00 5/691 |
| 2014/0101850 | A1 * | 4/2014 | Cuneo | A47G 9/0246 5/497 |
| 2014/0150181 | A1 * | 6/2014 | Tulloch | A47G 9/04 5/496 |
| 2014/0359948 | A1 * | 12/2014 | Middlesworth | A47C 31/00 5/690 |
| 2016/0007774 | A1 * | 1/2016 | Kakabeeke | A47G 9/0246 5/496 |
| 2016/0242559 | A1 | 8/2016 | Hui | |
| 2017/0280901 | A1 * | 10/2017 | Johnson | A47G 9/0246 |
| 2018/0070748 | A1 * | 3/2018 | Bell | A47C 31/105 |
| 2019/0261779 | A1 * | 8/2019 | deVilleneuve | A47C 21/028 |

* cited by examiner

BED SHEET/BED COVERING SECURING DEVICE AND METHOD

CROSS-REFERENCE TO RELATED APPLICATIONS

This application claims the benefit of U.S. Provisional Patent Application Ser. No. 62/663,136, filed 26 Apr. 2018; U.S. Provisional Patent Application Ser. No. 62/697,711, filed 13 Jul. 2018; U.S. Provisional Patent Application Ser. No. 62/720,914, filed 21 Aug. 2018; and U.S. Provisional Patent Application Ser. No. 62/732,257, filed 17 Sep. 2018, each of which is hereby incorporated herein by reference.

Priority of U.S. Provisional Patent Application Ser. No. 62/663,136, filed 26 Apr. 2018; U.S. Provisional Patent Application Ser. No. 62/697,711, filed 13 Jul. 2018; U.S. Provisional Patent Application Ser. No. 62/720,914, filed 21 Aug. 2018; and U.S. Provisional Patent Application Ser. No. 62/732,257, filed 17 Sep. 2018, each of which is hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a device and method for holding bed sheets, blankets, or other bed coverings on a mattress. More particularly, the present invention relates to a sleeve device or retaining device used to hold fitted sheets and flat sheets on the top of a mattress, preferably neatly in position on the mattress.

2. General Background of the Invention

In order to place or remove fitted and flat sheets from a mattress, it is usually necessary to lift the mattress at the corners. This requires a considerable amount of effort and labor for the person putting on the sheets. Moreover, there is a tendency for the fitted sheet to rip or tear, e.g., over time, due to the great amount of strain caused by pulling the fitted sheet over the mattress corners and removing it from the corners of the mattress.

The following patents and publications are hereby incorporated herein by reference:

U.S. Pat. Nos.: 170,573; 267,498; 728,204; 1,833,298; 1,982,998; 2,284,778; 2,860,352; 2,924,833; 2,931,084; 3,092,848; 4,662,016; 4,809,375; 4,829,617; 4,891,856; 5,148,560; 5,218,729; 6,457,194; 6,601,250; 8,464,377; 8,707,482; D637,858;

U.S. Publications Nos.: 2004/0060113; 2009/0172881; 2010/0162486; 2012/0233777; 2016/0242559

Foreign References: DE2442451

The following web pages and/or websites are hereby incorporated herein by reference and were filed with U.S. Provisional Patent Application Ser. No. 62/697,711, filed 13 Jul. 2018:

Adjustable Bed Sheet Grippers—AmeriMark (https://www.amerimark.com/adjustable-bed-sheet-grippers/

121183.html?afsrc=1&cm_mmc=PaidSearch-_-Google-PLA-_-FreeShip-_-12118300000&media=PAP0181&gclid=Cjw);

Adjustable-Heavy-Grippers-Holders-Suspenders (https://www.amazon.com/Adjustable-Heavy-Grippers-Holders-Suspenders/dp/B00MNBPZFE);

Hold-On-Sheet-Huggers (https://www.amazon.com/Hold-On-hold-Sheet Huggers/dp/B00JCEZVQ8);

Bed Sheet Grippers (https://www.google.com/search?q=bed+sheet+grippers&oq=bed+linen+gripper&aqs=chrome.1.69i57j015.7003j0j7&sourceid=chrome&ie=UTF-8);

Bed Sheet Grippers Garters Bedding Straps Suspenders (http://www.sears.com/search=bed%20sheet%20grippers%20garters%20bedding%20straps%20suspenders Drive Medical Mattress Cover (https://precisionmedicalsupplies.com/drive-medical-universal-mattress-cover-with-defined-perimeter.html/#136=1061);

How to Keep Mattress Covers on Beds (http://homeguides.sfgate.com/keep-mattress-covers-beds-97656.html);

Keeping-Sheets-on-the-Bed (https://www.thriftyfun.com/Keeping-Sheets-on-the-Bed.html);

Mattress Perimeter Covers (https://www.medline.com/product/Defined-Perimeter-Mattress-Covers-by-Posey-Company/Parts-and-Accessories/Z05-PF58316).

BRIEF SUMMARY OF THE INVENTION

The present invention includes a device, system, method and/or mechanism to hold a fitted sheet and a flat sheet on a mattress so that the fitted sheet and flat sheet can be secured onto and removed from a mattress with a minimum amount of effort.

In one or more preferred embodiments of the present invention, the device comprises an elastic material or a material that can stretch, and the device has a shape to fit at least along sides of a mattress. The force of the elastic or stretchy material can hold one or more sheets in place on the mattress. The device can be a sleeve, a band, a sheet securing device, and/or a bed sheet/bed cover securing device.

In one or more preferred embodiments, the force of the stretchy or elastic material, and nothing else, holds the sheets in place on the mattress.

The location of the elastic or stretch force of the sheet holder device can vary as desired.

In one or more preferred embodiments, the elastic or stretch force can be located at corners of the device.

In one or more preferred embodiments, the elastic or stretch force can be located along side panels of the device.

In one or more preferred embodiments, the elastic or stretch force can be located along end panels of the device.

In one or more preferred embodiments, the elastic or stretch force can be located along a bottom of the device.

In one or more preferred embodiments, the material of the device can provide the elastic or stretch force that holds the sheets or covers in place on the mattress.

In one or more preferred embodiments, the material of the side panels of the device can provide the elastic or stretch force that holds the sheets or covers in place on the mattress.

In one or more preferred embodiments, the material of corner portions of the device can provide the elastic or stretch force that holds the sheets or covers in place on the mattress.

In one or more preferred embodiments, the material of the end panels can provide the elastic or stretch force that holds the sheets or covers in place on the mattress.

In one or more preferred embodiments, additional portions of the device, e.g., elastic bands or straps, or bands or straps of another type of stretchy material, can be coupled to the material of the device and can provide stretch or elastic force to hold sheets in place on a mattress, either alone or in combination with an elastic or stretchy material of the device.

In one or more preferred embodiments, additional portions of the device, e.g., elastic bands or straps, or bands or straps of another type of stretchy material, can be coupled to the material of the device and can provide stretch or elastic force to hold sheets in place on a mattress, either alone or in combination with an elastic or stretchy material of the device, and/or alone or in combination with one or more of another desired fastener, e.g., magnets, hook and loop fasteners (e.g., Velcro® hook and loop fasteners), grommets, snaps, draw cord, tie, or other desired fasteners used to help hold the sheets in place.

In one or more preferred embodiments, the device can be manufactured as an integral part of a mattress.

In one or more preferred embodiments, the device is not an integral part of a mattress.

In one or more preferred embodiments, the device can be manufactured as a separate device to be positioned on a mattress.

In one or more preferred embodiments, the device can be removably securable to a mattress.

In one or more preferred embodiments, the present invention provides a mechanism to quickly and easily secure fitted sheets and/or flat sheets onto a mattress and remove the sheets from the mattress without excessively lifting the mattress.

In one or more preferred embodiments, the present invention provides a mechanism to quickly and easily secure fitted sheets and/or flat sheets onto a mattress and remove the sheets from the mattress without lifting the mattress.

In one or more preferred embodiments, the present invention provides a mechanism to quickly and easily secure fitted sheets and/or flat sheets onto a mattress and remove the sheets from the mattress with minimal lifting, if any, of the mattress.

In one or more preferred embodiments, a bed can be made using only flat sheets and not fitted sheets that include elastic.

In one or more preferred embodiments a bed can be made using only flat sheets and not fitted sheets that include elastic, and the bed can be made without having to lift a mattress.

In some preferred embodiments, fitted and flat sheets can be positioned on and/or secured to, and/or removed from a mattress without having to lift a mattress at all.

In one or more preferred embodiments, the present invention includes that while the sheets are on the mattress, the sheets can be securely and properly oriented on the mattress to present a smooth, neat appearance.

In one or more preferred embodiments, the present invention provides a sleeve or band that can hold objects on the side of the bed such as a cell phone, book or other personal items.

In one or more preferred embodiments, the present invention includes a bed sheet/bed cover securing device and system comprising a mattress having a top, a bottom, and side walls, a sleeve having a bottom panel, side panels, end panels and a top edge, wherein the top edge includes a securing, gripping, or positioning element, e.g., elastic or other suitable securing element, and wherein the sleeve covers a mattress bottom and side walls when placed on a mattress, and wherein the securing, gripping, or positioning element sits below the top edge of the mattress.

In various embodiments, a securing, gripping, or positioning element, e.g., elastic or other suitable securing element, can be included at or near the bottom edge of the sleeve.

In various embodiments, a securing, gripping, or positioning element, e.g., elastic or other suitable securing element, can be included at or near the top edge of the sleeve.

In one or more preferred embodiments, the present invention includes a bed sheet securing device for use with a mattress having a top, a bottom, and side walls. The bed sheet securing device comprises a sleeve having a bottom panel, side panels, end panels and a top portion. Preferably the top portion includes a securing, gripping, or positioning element, e.g., elastic or other suitable securing element, and wherein the sleeve covers the mattress bottom, end walls and side walls when placed on the mattress, and wherein the securing element is positioned below the top edge of a mattress.

In various embodiments, a top portion of the sleeve includes a securing, gripping, or positioning element that helps grip the sleeve to the mattress and/or hold the sleeve in place on the mattress. The securing, gripping or positioning element can be elastic. The securing element can also be a draw string or other fastener that preferably has gripping force, or that can be tightened to apply force, to hold sheets in place on a mattress.

In one or more preferred embodiments, the present invention further comprises one or more magnets on the side panels of the sleeve. The one or more magnets can help hold the sleeve in place on a mattress.

In one or more preferred embodiments, the present invention further comprises one or more magnets on the side walls of the mattress. The one or more magnets can help hold the sleeve in place on a mattress.

In one or more preferred embodiments, the magnets on the side panels connect with the magnets on the side walls.

In one or more preferred embodiments, the magnets on the side panels connect with metal, e.g., springs of a mattress.

In one or more preferred embodiments, a sleeve or other bed covering securing device does not have a bottom panel.

In some preferred embodiments, a sleeve or other bed covering securing device includes side panels, and end panels and does not have a bottom panel.

In some preferred embodiments a sleeve or other bed covering securing device includes side panels and at least one end panel and does not have a bottom panel.

In some preferred embodiments, a sleeve or other bed covering securing device includes side panels, and end panels and has a bottom portion that extends a desired distance under and along a bottom surface of a mattress but not completely across a bottom surface of the mattress.

In some preferred embodiments, a sleeve or other bed covering securing device includes side panels, and at least one end panel and has a bottom portion that extends a desired distance under and along a bottom surface of a mattress but not completely across a bottom surface of the mattress.

In one or more preferred embodiments, a sleeve bottom panel or bottom portion is a thinner material than the other sleeve panels.

In some preferred embodiments, a sleeve bottom panel or bottom portion has dimensions corresponding to a bottom surface of a mattress.

In one or more preferred embodiments, the present invention includes a bed sheet/bed cover securing device or sleeve. The bed sheet/bed cover securing device or sleeve can have a bottom panel, side panels, end panels and a top edge. The bed sheet/bed cover securing device or sleeve can be fitted around a periphery of a mattress, wherein the bed sheet/bed cover securing device or sleeve can be positioned under the mattress bottom and covers side walls and end walls, with the top edge of the bed sheet/bed cover securing device or sleeve ending at or about near the top of the mattress, so that it preferably does not extend onto a top of the mattress. The bed sheet/bed cover securing device or sleeve can include a securing, gripping, or positioning element, e.g., elastic or other suitable securing element, at least at or near the top edge of a mattress for helping to grip sheets or bed covers in place on the mattress.

In various embodiments, a securing, gripping, or positioning element, e.g., elastic or other suitable securing element, can be included at or near the bottom edge of a sleeve or bed sheet/bed cover securing device.

In various embodiments, a securing, gripping, or positioning element of a sleeve or bed sheet/bed cover securing device, e.g., elastic or other suitable securing element having stretch or elastic force, can be the material of the bed sheet/bed cover securing device or sleeve itself, e.g., of a side panel, end panel, and/or corner portion.

In one or more preferred embodiments, the present invention includes a bed sheet/bed cover securing device or sleeve. The bed sheet/bed cover securing device or sleeve can have side panels, end panels and a top edge. The bed sheet/bed cover securing device or sleeve can be fitted around a periphery of a mattress, wherein the bed sheet/bed cover securing device or sleeve can be positioned to cover the side walls and end walls of the mattress, with a top edge of the sleeve ending at or about near the top of the mattress, so that it preferably does not extend onto a top of the mattress. The bed sheet/bed cover securing device or sleeve can include a securing or gripping or positioning element, e.g., an elastic portion, e.g., at least at or near the sleeve top edge for helping to grip sheets or other bed covers in place on the mattress.

In one or more preferred embodiments, the bed sheet/bed cover securing device or sleeve can grip sheets in place on the mattress with a magnet system on the bed sheet/bed cover securing device or sleeve and on the mattress.

In another preferred embodiment, the bed sheet/bed cover securing device or sleeve can grip sheets in place on a mattress with a magnet system on the bed sheet/bed cover securing device or sleeve and on the mattress, and also with an elastic portion on the bed sheet/bed cover securing device or sleeve.

In another preferred embodiment, the bed sheet/bed cover securing device or sleeve can grip sheets in place on a mattress with a magnet system on the bed sheet/bed cover securing device or sleeve and/or on the mattress and also with an elastic portion on the bed sheet/bed cover securing device or sleeve.

In some preferred embodiments, the bed sheet/bed cover securing device or sleeve may include pockets for storing items, e.g., a phone, tablet, books, or other desired item.

In one or more preferred embodiments, the bed sheet/bed cover securing device or sleeve can extend to the mattress bottom panel.

In one or more preferred embodiments, the bed sheet/bed cover securing device or sleeve does not extend to the mattress bottom panel.

In one or more preferred embodiments, the bed sheet/bed cover securing device or sleeve can be fitted around a periphery of a mattress, wherein the bed sheet/bed cover securing device or sleeve can be positioned to cover side walls and end walls of the mattress, with the top edge of the sleeve ending at or near the top of the mattress, and the bottom edge of the sleeve ending above the bottom surface of the mattress.

In one or more preferred embodiments, the bed sheet/bed cover securing device or sleeve can be made of one continuous piece of fabric.

In one or more preferred embodiments, the bed sheet/bed cover securing device or sleeve can be made of one continuous piece of material.

In one or more preferred embodiments, the bed sheet/bed cover securing device or sleeve can be secured to a mattress with fasteners preferably at the corners. The fasteners preferably allow for adjustment of positioning or tension of the bed sheet/bed cover securing device or sleeve on the mattress. The fasteners are preferably adjusted at the first time the bed sheet/bed cover securing device or sleeve is placed on the mattress.

In one or more preferred embodiments, the bed sheet/bed cover securing device or sleeve can include a securing element with gripping force, such as for example a fastener, that can include a pull cord mechanism, hook and loop straps (e.g., Velcro® straps), grommets, button holes or some other fastening mechanism on the sleeve panels. The fasteners can be located at or around the bed sheet/bed cover securing device or sleeve corners, on the sides, head panel, and/or foot panel of the bed sheet/bed cover securing device or sleeve. The fasteners preferably allow that the elastic, cord or fabric can be pulled and tightened and affixed either at all or some of the corners, or somewhere along the sides, head or foot panels of the bed sheet/bed cover securing device or sleeve, at or near the top of the mattress periphery.

In one or more preferred embodiments, bed sheet/bed cover securing device or sleeve securing elements and/or fasteners can include any one, or a combination of one or more, of the following for holding or gripping the sleeve in place on a mattress: elastic, magnets, corner fasteners, pull cord, drawstring, hook and loop straps (e.g., Velcro® straps), or portions, grommets, buttons and button holes.

In one or more preferred embodiments, one or more sleeve securing devices and/or fasteners are included on a bed sheet/bed cover securing device or sleeve. In one or more preferred embodiments, one or more sleeve securing devices and/or fasteners can be included on a mattress. In one or more preferred embodiments the securing devices and/or sleeve fasteners can be included on a bed sheet/bed cover securing device or sleeve and on a mattress.

In one or more preferred embodiments, the panels (e.g., a pair of side, head, and foot panels) of a bed sheet/bed cover securing device or sleeve can preferably extend under the bed. In one preferred embodiment, the panels of a bed sheet/bed cover securing device or sleeve are preferably not limited to the sides, head and foot areas of mattress.

In one or more preferred embodiments, panels (e.g., a pair of side, head, and foot panels) of a bed sheet/bed cover securing device or sleeve can be four separate panels or pieces of material.

In one or more preferred embodiments, the panels of a bed sheet/bed cover securing device or sleeve can be combined into one, two, or three pieces of material.

In one or more preferred embodiments, the bottom panel of a bed sheet/bed cover securing device or sleeve can be unaffixed to one or more sides of the mattress.

In one or more preferred embodiments, the bottom panel of a bed sheet/bed cover securing device or sleeve can be affixed to one or more sides of the mattress.

In one or more preferred embodiments, there can be pockets on the inner side of one or more of the panels of a bed sheet/bed cover securing device or sleeve.

In one or more preferred embodiments, there can be pockets on the outer side of one or more of the panels of a bed sheet/bed cover securing device or sleeve.

In one or more preferred embodiments, there can be hard pieces, grip pads, or other non-slip material preferably affixed to a bed sheet/bed cover securing device or sleeve, to prevent sliding on either inside or outside of the sleeve, and preferably at the corners, midpoint or other desired positions on the sleeve. Preferably any such hard pieces, grip pads or other non-slip material are at least affixed in or on an inside surface of the sleeve corner for keeping the corner in place on a mattress.

In one or more preferred embodiments, there can be hard pieces, grip pads, or other non-slip material preferably affixed to a bed sheet/bed cover securing device or sleeve to prevent sliding either inside or outside of the sleeve at any desired location on the sleeve material. In embodiments in which the sleeve includes a bottom portion, preferably hard pieces, grip pads, or other non-slip material(s) are affixed to the sleeve so that they can keep the bottom portion of the sleeve in place under the bed or mattress and prevent the sleeve from sliding out.

In one or more preferred embodiments, the present invention includes a device for securing bed sheets or other bed covers on a mattress having a bottom panel, a top panel and side walls, the device including a sleeve having a bottom panel, side panels, end panels and a top portion, e.g., a top edge, wherein the top portion or top edge includes a securing or gripping or positioning element, e.g., an elastic portion. The sleeve preferably covers the mattress bottom and side walls when placed on the mattress, wherein the securing or gripping or positioning element preferably sits below the surface of the mattress top panel or top surface. The securing or gripping or positioning element is preferably capable of securing the bed sheets or bed covers in the sleeve panels and on the mattress.

In various embodiments, a securing, gripping, or positioning element, e.g., elastic or other suitable securing element, can be included at or near the bottom edge of a sleeve or other bed sheet/bed cover securing device.

In one or more preferred embodiments, the present invention includes a device for securing bed sheets on a mattress having a bottom, a top surface, and side and end walls, the device including a sleeve having side panels, end panels and a top edge, and wherein the sleeve can be fitted around the mattress side and end walls. A securing, gripping, or positioning element, e.g., elastic or other suitable securing element, can be provided on the sleeve top portion or top edge, wherein the securing, gripping, or positioning element, e.g., elastic or other suitable securing element, can be placed around mattress side and end walls at a position below the mattress top surface. The securing, gripping, or positioning element, e.g., elastic or other suitable securing element, can be capable of securing the bed sheets or other bed covers in the sleeve panels and on the mattress.

In one or more preferred embodiments, the present invention includes a method for securing bed sheets or bed covers on a mattress having a bottom, a top surface, and side and end walls, the method comprising the steps of:

a) providing a sleeve having side panels, end panels, a top edge, and a securing, gripping, or positioning element, e.g., elastic or other suitable securing element, at the top edge;

b) placing the securing, gripping, or positioning element around the mattress side and end walls, wherein the securing, gripping, or positioning element is stretched around the mattress side and end walls and positioned at a distance below the mattress top surface;

c) laying the bed sheets on the mattress top surface and tucking ends of the bed sheets into the securing, gripping, or positioning element, wherein the securing, gripping, or positioning element is of a strength to secure the sleeve and the bed sheets to the mattress.

In various embodiments, a sheet securing device can be manufactured to be positioned on a standard sized mattress, e.g., twin, full, queen, king or California king mattresses.

In various embodiments, a sheet securing device can be manufactured as part of a mattress and/or to be positioned on a standard size mattress, e.g., twin, full, queen, king or California king mattresses, or to be positioned on a custom mattress, or on other mattress sizes that are currently available or become available in the future.

In various embodiments, a sheet securing device can be manufactured with custom dimensions as desired.

In various embodiments, a sheet securing device can be manufactured for use with an air mattress or other transportable mattress.

In various embodiments, a sheet securing device can be manufactured as part of a mattress.

In various embodiments, a securing, gripping, or positioning element, e.g., elastic or other suitable securing element, can be included at or near the bottom edge of a sleeve or sheet securing device.

In various embodiments, a securing, gripping, or positioning element e.g., elastic or other suitable securing element, can be included at or near the bottom perimeter edge of a sleeve or sheet securing device.

In various embodiments, one or more securing elements with gripping force, such as for example elastic straps or other suitable securing elements, can be affixed to a side sleeve panel, extend to across the bottom of the mattress, and be affixed to an opposite side sleeve panel.

In various embodiments, one or more securing elements with gripping force, such as for example elastic straps or other suitable securing elements, can be affixed to the head/end or foot/end sleeve panel, extend across the bottom of the mattress, and be affixed to an opposite head/foot/end sleeve panel.

In various embodiments, one or more securing elements with gripping force, such as for example elastic straps or other suitable securing elements with gripping force, can be affixed to the sides, head/end, and foot/end sleeve panels and can be covered with a fabric panel.

In one or more preferred embodiments, the present invention includes a device for securing a bed sheet to a mattress, the mattress having a bottom panel, a top panel, a periphery and side walls. The device includes a sleeve or band having side panels, end panels and a top portion, wherein the top portion includes a securing, gripping, or positioning element, and wherein the sleeve covers the mattress bottom and side walls when placed on the mattress. Preferably all or part of the securing, gripping, or positioning element can be positioned below the surface of the mattress top panel. The securing, gripping, or positioning element preferably secures a bed sheet in between the sleeve and the mattress.

In one or more preferred embodiments, the present invention includes a device for securing bed sheets on a mattress having a bottom panel, a top panel, a periphery with side walls and corners. The device preferably includes a band having a length that extends around the periphery of the mattress, wherein the band includes a securing, gripping, or positioning element. Preferably all or part of the securing, gripping, or positioning element of said band is located below the top panel. The securing, gripping, or positioning element preferably secures a bed sheet in between the band and the mattress.

In various embodiments, the band preferably includes one or more elastic panels.

In one or more preferred embodiments, a sleeve or band of a bed sheet/bed cover securing device includes a stretch force that will hold the sheets or bed linens or covers to the sides of the mattress so a user does not have to tuck the sheets under the mattress but can tuck along the sides of the mattress. Different combinations of fabric or material including stretch force and fabric or material not including stretch force can be used in a sleeve or band. The location of the stretch force of the sleeve or band can vary as desired, e.g., the stretch force can be positioned at corners, along sides, along ends, and/or along a bottom portion of a sleeve or band. The location of the stretch force can be at, or about, near an edge or top portion of a sleeve or band or at a location that is in between edges or a top portions of a sleeve or band.

In some embodiments stretch force of a sleeve or band along the sides of the mattress holds the sheets in place on the mattress.

In some embodiments stretch force of a sleeve or band along the corners of the mattress holds the sheets in place on the mattress.

In some embodiments stretch force of a sleeve or band along the ends of the mattress holds the sheets in place on the mattress.

In some embodiments stretch force of a sleeve or band along the middle of the sides of the mattress holds the sheets in place on the mattress.

In one or more preferred embodiments, multiple layers of fabric or material can be included in a sleeve or band, e.g., 2, 3, 4, or more layers of fabric or material can be included in a sleeve or band, e.g., along side portions, along end portions, or along corners.

In one or more preferred embodiments, multiple layers of fabric or material can be included in a sleeve or band at the location of the stretch force, e.g., 2, 3, 4, or more layers of fabric or material can be included in a sleeve or band at the location of the stretch force.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
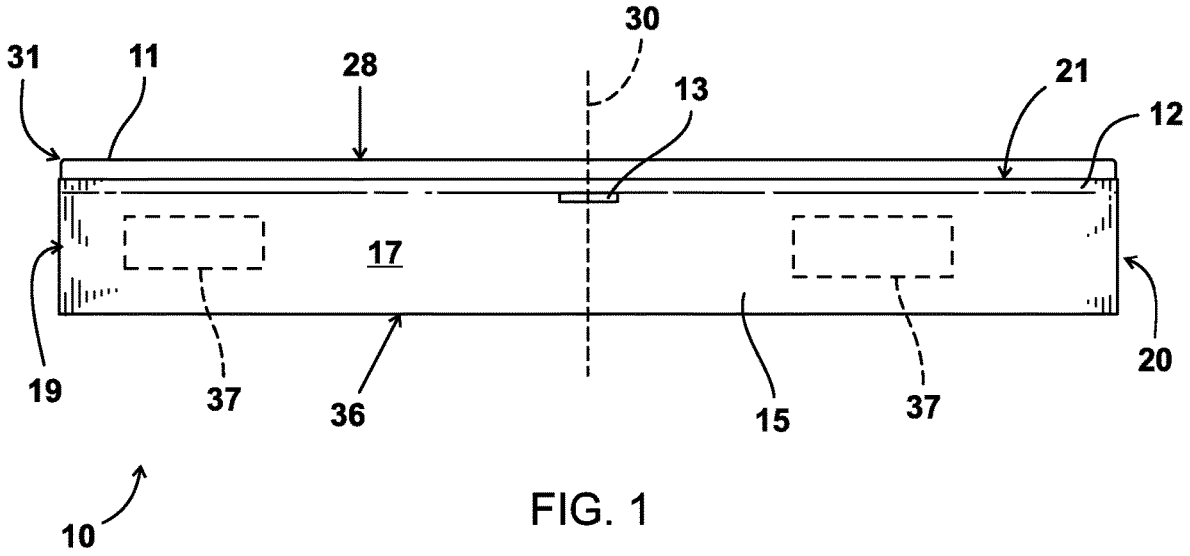
FIG. 1 is a side view of a first preferred embodiment of the apparatus of the present invention.
Figure 2:
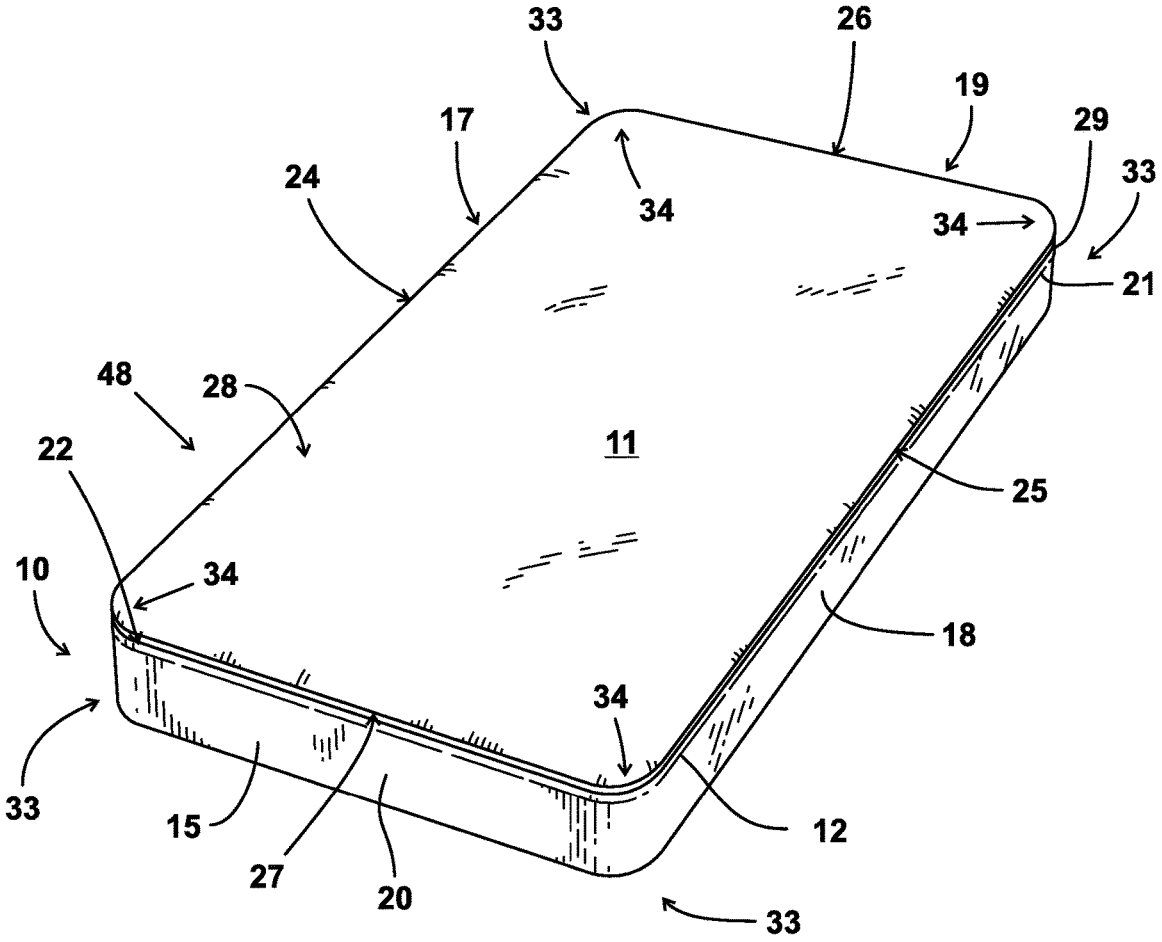
FIG. 2 is a top perspective view of the first preferred embodiment of the apparatus of the present invention.
Figure 3:
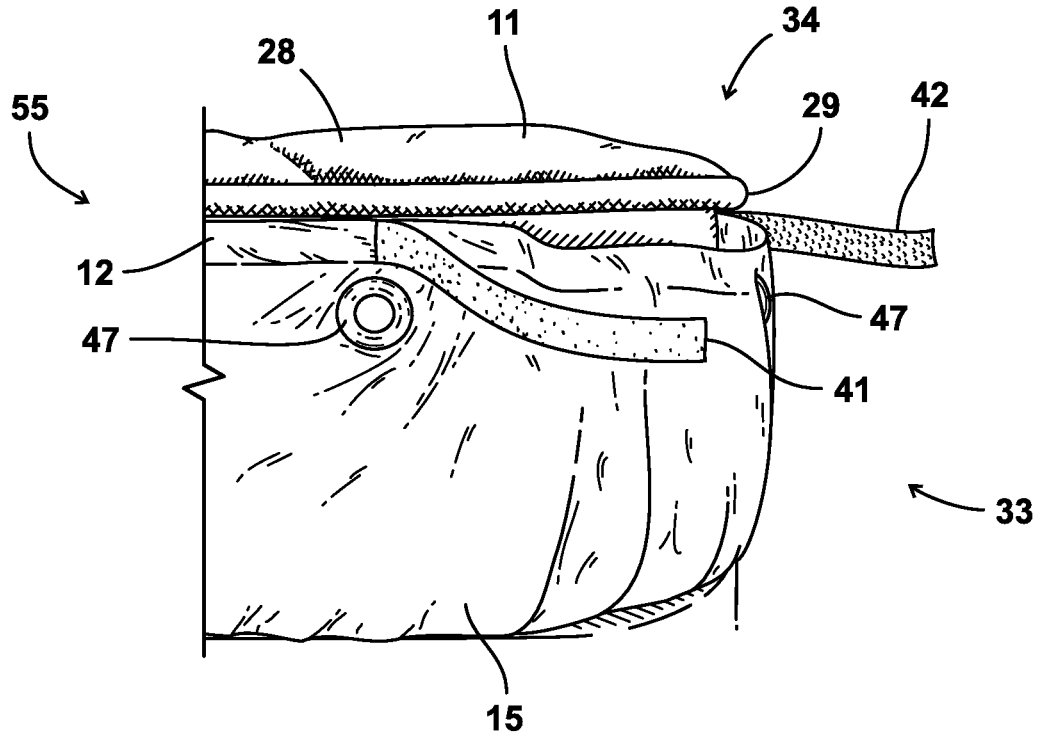
FIG. 3 is a partial elevation view of a second preferred embodiment of the apparatus of the present invention, including a sleeve corner portion with fasteners on a mattress.
Figure 4:
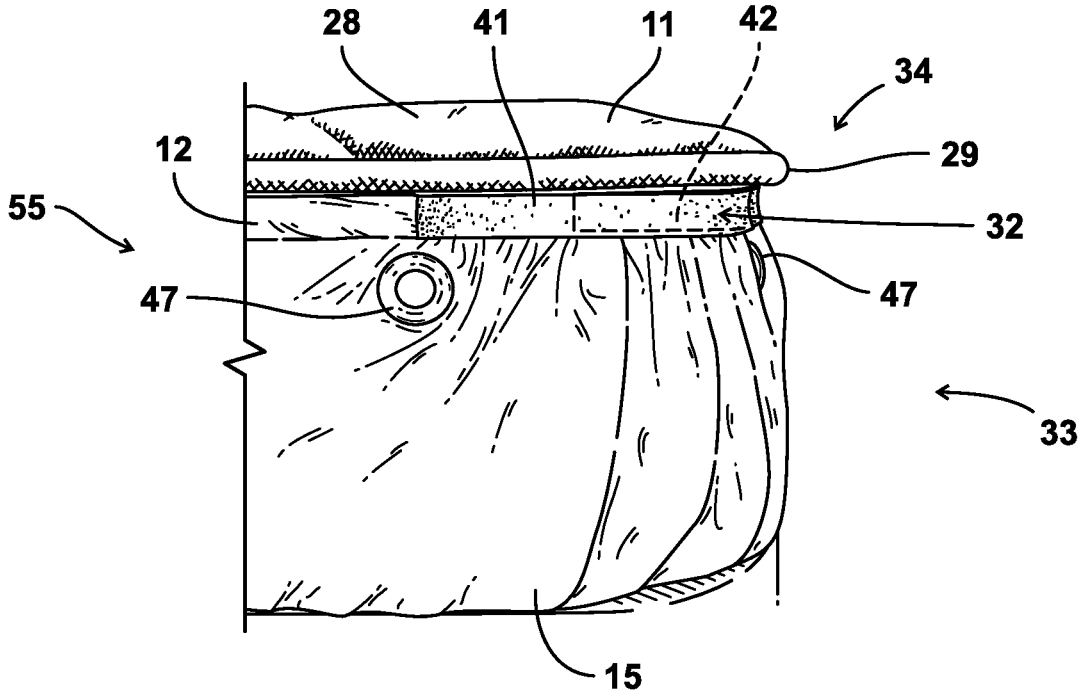
FIG. 4 is a partial elevation view of the second preferred embodiment of the apparatus of the present invention, including a sleeve corner portion with fasteners on a mattress.
Figure 5:
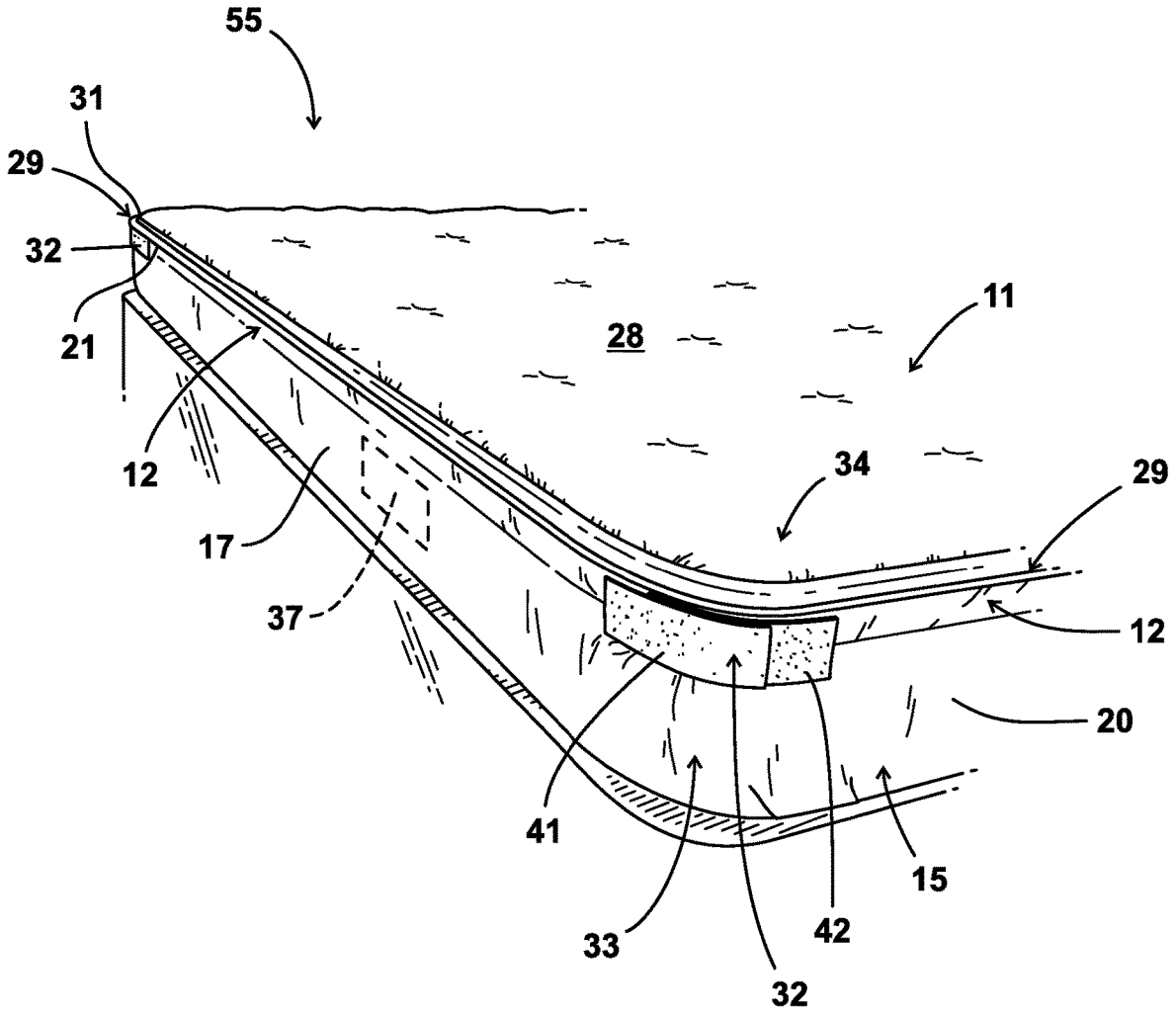
FIG. 5 is partial perspective view of the second preferred embodiment of the apparatus of the present invention, showing the sleeve on a mattress.
Figure 10:
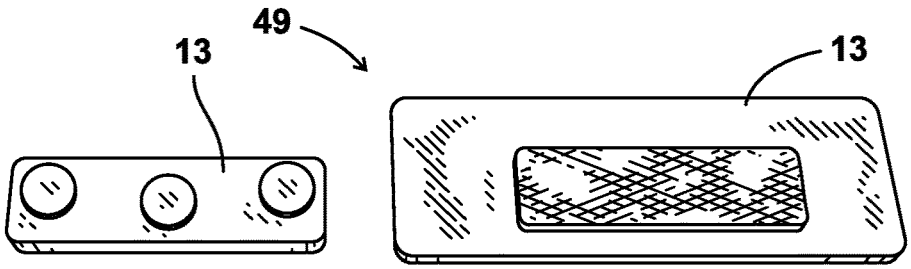
FIG. 10 is a view of magnetic portions that can be included in one or more preferred embodiments of the apparatus and method of the present invention.

FIGS. 1-2 and 10 show views of a first preferred embodiment of a sleeve or band device, apparatus and system of the present invention, designated generally by the number 10. In a first preferred embodiment, a sleeve 15 preferably has side panels 17, 18, end panels 19, 20, and a corner or corner portion 33. A sleeve 15 can also be a band and is sometimes referred to herein as a band. In some embodiments, sleeve 15 can have a bottom panel 16. In some embodiments, sleeve 15 does not have a bottom panel 16. In a preferred embodiment, sleeve 15 includes side panels 17, 18 and at least one end panel 19, 20, and does not have a bottom panel 16. In embodiments that do include a bottom panel 16, preferably bottom panel 16 can be a thinner material than the other side panels 17, 18, and end panels 19, 20. A bottom panel 16, if included in the first preferred embodiment, can be the same or similar to bottom panel 16 of FIGS. 6 and 22, for example.

Sleeve 15 can be comprised of four (4) separate pieces/parts/portions of fabric material, including the side panels 17, 18 and end panels 19, 20 with four (4) corners/corner portions 33 formed at junctions of respective side and end panels, e.g., as shown in FIG. 2. Each piece, part or portion of fabric material, including side 17, 18 and end 19, 20 panels of sleeve 15, can be rectangularly-shaped and preferably sewn together to create a continuous band of fabric that is placed around and secured to or against mattress 11 side walls/portions 24, 25, and mattress end walls/portions 26, 27. Junctions of side panels 17, 18, and end panels 19, 20 of sleeve/band 15 can form corner portions 33, which can have gussets.

Figure 6:
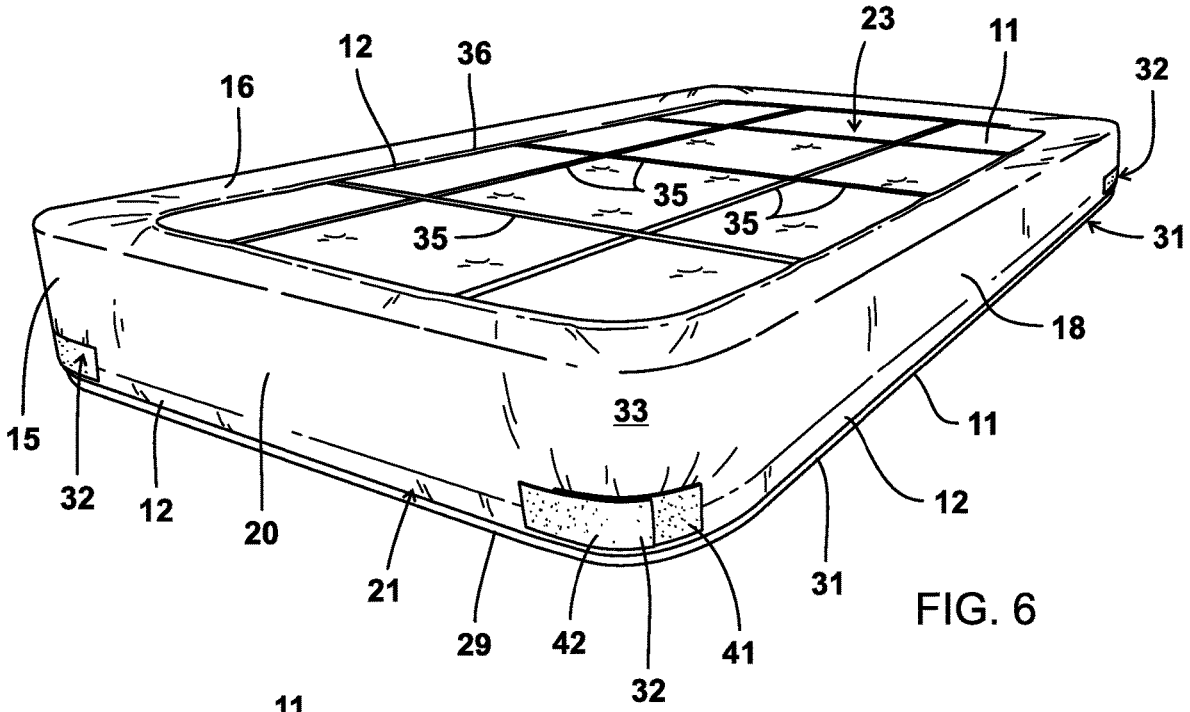
FIG. 6 is a partial perspective bottom view of the second preferred embodiment of the apparatus of the present invention, showing the bottom of a mattress with attached sleeve.
Figure 7:
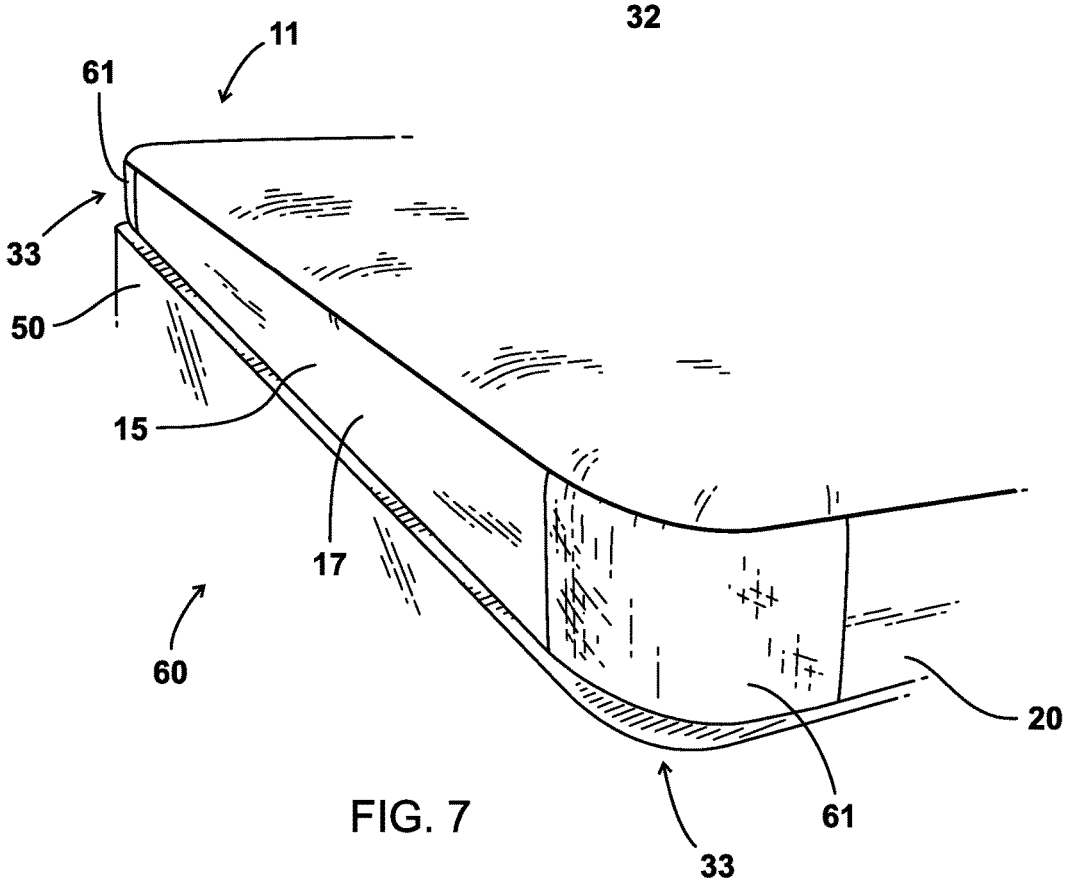
FIG. 7 is a partial perspective view of a third preferred embodiment of the apparatus of the present invention, showing a mattress with attached sleeve.
Figure 25:
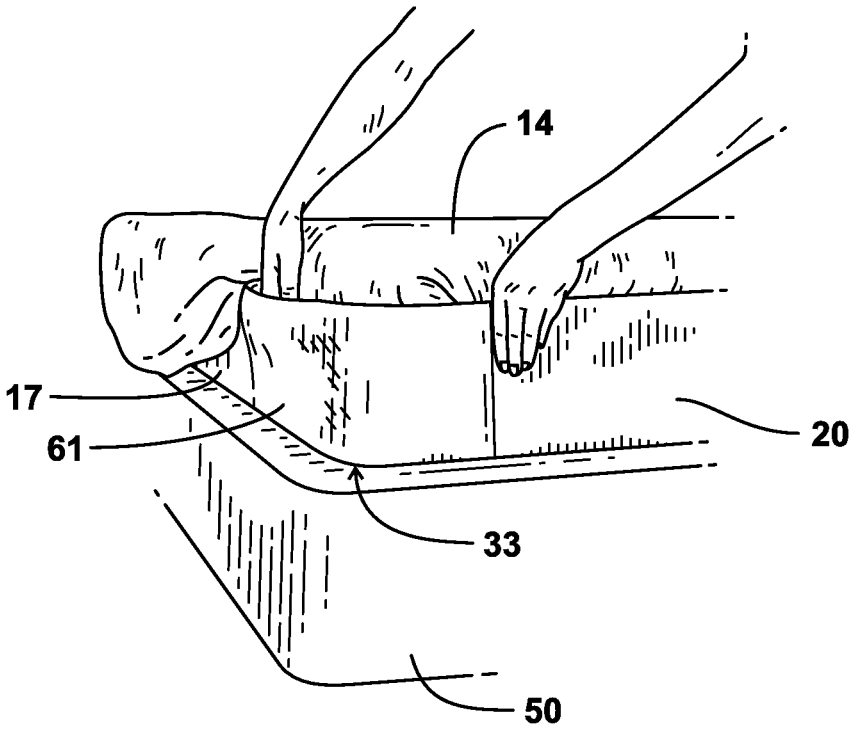
FIG. 25 is a partial perspective view of a method of the third preferred embodiment of the apparatus of the present invention, showing a step of tucking in sheets or bed covers in between the apparatus of the present invention and the mattress.

Sleeve or band 15 of the first preferred embodiment can be used for securing bed sheets 14 on a mattress 11 having a bottom/bottom portion 23, a top/top portion 28, and a periphery 48 including side walls/portions 24, 25, end walls/portions 26, 27 and corners/corner portion 34 (see FIG. 2 and also FIG. 6 illustrating mattress bottom/bottom portion 23). Bed sheets 14 can be tucked in between sleeve or band 15 of the first preferred embodiment and mattress 11 in a similar manner as shown in FIG. 25. Sleeve or band device 10 of the first preferred embodiment of the present invention preferably includes a sleeve or band 15 having a length that extends around the periphery 48 of mattress 11, wherein sleeve or band 15 includes a securing, gripping, or positioning element 12. Preferably all or part of the securing, gripping, or positioning element 12 of sleeve or band 15 is located below a mattress top panel 28 when sleeve or band 15 is positioned around mattress 11. The securing, gripping, or positioning element 12 preferably can secure a bed sheet 14 in between sleeve or band 15 and mattress 11.

Preferably material for at least the side panels 17, 18, end panels 19, 20, and corner panels 33 are selected so as to provide enough stretch and give when pulling the device 15 onto the mattress 11 but not too much stretch or give that would prevent the device 15 from snuggly holding sheets or other bed linens or covers 14 in place on the mattress 11 when the sheets or other bed linens or covers 14 are tucked in between the device 15 and the mattress 11. If corner portions 33 have a lot of stretch capacity, for example, side 17, 18 or end panels 19, 20 potentially can have no stretch capacity or very little stretch capacity. If the side 17, 18 and/or end panels 19, 20 have a lot of stretch capacity, the corner panels 33 can potentially have no or less stretch capacity. If each of the side panels 17, 18, end panels 19, 20 and corner panels 33 will have some stretch capacity, the dimensions of the materials can be selected based on the dimensions of the mattress 11 for which it will be used with, so that there is enough stretch capacity, to be pulled over the mattress 11 but not too much stretch so that the device 15 can hold the bed sheets or linens 14 in place on the mattress 11.

For example, in one or more preferred embodiments, a material, e.g., elastic and/or spandex with stretch capacity, can be provided at all four corners/corner panels 33. When the device is stretched to be positioned on a mattress 11, stretch of the material may occur at 1, 2, 3, or all 4 of the corners 33. In an embodiment for which there are about 9 inch corners/corner panels 33 in unstretched state, the 9 inch corner/corner panel 33 can for example stretch to about 12 inches when a stretchable material, e.g., elastic, that is considered to be very taut and difficult to stretch is pulled to the max. A corner/corner panel 33 does not generally need to be stretched to the max in order to pull the corner 33 a little bit to get it over the corner 34 of the mattress 11. After stretching over the corner 34 of the mattress 11, preferably the material of the corner/corner panel 33 then moves back into place and stays taut. A user can then proceed to place each of the 4 corners/corner panels 33 and pull the device to get each corner/corner panel 33 over the mattress corner 34. If the stretchy fabric or material (or the elastic under the spandex) has more stretch capacity than the max stretch as mentioned above, then the length of the stretchy fabric or material of corner/corner panel 33 can be shorter than 9 inches to provide enough tautness when positioned on the mattress. If the stretchy fabric/material (or the elastic underneath) is more taut than the max stretch as described above, then corner/corner panel 33 can have a length longer than 9 inches to provide enough stretch capacity to pull the device over a mattress corner 34.

The stretch capacity of the device can be placed at any point or points on the device as desired, paying attention to the ratio of stretchy to non-stretchy fabric/material in the device to ensure that the device can be pulled onto a mattress 11 and remain taut when positioned on mattress 11 to hold sheets 14 in place between the device and mattress 11.

Sleeve/band 15 is preferably made of a fabric material, such as for example, elastic and/or spandex, cotton, polyester, neoprene or other desired material or a combination thereof. Sleeve side 17, 18 and end 19, 20 panels can be made of an elastic material and/or of spandex, cotton, polyester, neoprene or other synthetic or natural material, and/or of a combination of one or more of the aforementioned materials. Sleeve side 17, 18 and end 19, 20 panels can be made of one or more types of material currently known, or to be developed in the future, that provide stretch, elastic and/or flexible force. Sleeve side 17, 18 and end 19, 20 panels can also be made of inelastic, woven material, such as cotton, linen, linen-blend, light weight twill, denim, or any other suitable material or a combination thereof. Preferably, sleeve side 17, 18 and end 19, 20 panels can be made with a double layer of fabric, and preferably include a filling, such a batting (which can be a soft, thick material used as a lining or a layer of insulation between a top layer and a bottom layer, e.g., batting used in quilts), in between the double layers of fabric. Preferably, one or more sleeve side 17, 18 and end 19, 20 panels can be a double layer of fabric. A preferred construction of double layered fabric and batting/filling provides a clean or smooth appearance of the sleeve panels 17-20 when bed sheets 14 are tucked into the sleeve 15.

Sleeve side 17, 18 and end 19, 20 panels can be commercially available material, for example Fabricdirect.com Wholesale 102" Percale—Sheeting Fabric White 50-yard roll. Corners/corner panels 33 can be commercially available material, for example Top Value Fabrics/Shelly #103166 62/63 10.3 oz 88/12 Polyester/Spandex Double Circular Knit, Wicking Finish White. Securing, gripping, or positioning element 12 e.g., elastic or other suitable securing element, can be commercially available material, preferably for example WBC Industries 3 inch #white woven elastic ITEM #191/3W. Securing, gripping, or positioning element 12, e.g., elastic or other suitable securing element, can also be for example WBC Industries #330/3W Knitted Elastic White 3".

Sleeve 15 can have a top portion or edge 21 with a periphery 22 defined by side panels 17, 18, end panels 19, 20 and corner or corner portions 33. In some embodiments, top portion or edge 21 can include a securing, gripping, or positioning element(s), e.g., elastic or other suitable securing element 12 positioned at the top portion or edge 21. In various embodiments, the securing, gripping, or positioning element 12, e.g., elastic or other suitable securing element, can be included at or near a bottom edge or edge portion 36 of sleeve 15. Sleeve 15 can be wrapped around periphery 48, e.g., around side portions 24, 25 and end portions 26, 27 of a mattress 11. In various embodiments, sleeve 15 can also cover mattress bottom portion 23 or extend a distance along mattress bottom portion 23.

In one or more preferred embodiments, sleeve bottom edge 36 does not include a securing element and can be a free edge. When sleeve or band 15 is secured to mattress 11, the free bottom edge 36 of sleeve 15 can be tucked under mattress 11. In another embodiment, the free bottom edge 36 can stay untucked and extend a distance below the mattress bottom portion 23, such as for example, like a bed skirt. Sleeve or band 15 can also be sized so that a bottom edge or bottom portion 36 of sleeve or band 15 does not extend below mattress bottom portion 23.

Sleeve or band 15 can be made to any suitable size to fit the mattress 11 size. For example, a mattress 11 can be between about 5-20 inches in height, depending on the type and thickness of the mattress 11. Sleeve or band 15 can be used on mattresses for all kinds of beds, including bunk beds. Sleeve or band 15 of the present invention is preferably sized and shaped to fit any mattress size that is currently on the market. Sleeve or band 15 can preferably be sized and shaped to be used with any bedding sheets or linens that are currently on the market. Sleeve or band 15 preferably does not require any alteration for use with existing fitted sheets or flat sheets that are currently on the market. Preferably sleeve 15 can also be sized for use with mattresses and sheets or other bed linens or coverings to be developed in the future.

In various embodiments, sleeve 15 can include a securing, gripping or positioning element 12, e.g., an elastic portion or other suitable securing element, that is preferably used to hold sleeve 15 to a mattress 11. Securing element 12 can be affixed to the tops of side panels 17, 18 and end panels 19, 20 of the sleeve 15, e.g., as seen in FIGS. 1-6. The securing element 12 can be located at or near the top edge or top portion 21 of the sleeve perimeter or periphery 22 and can preferably sit below the mattress top edge 31. In various embodiments, a securing, gripping, or positioning element 12, e.g., elastic or other suitable securing element, can be included at or near the bottom edge or bottom portion 36 of the sleeve 15. Securing element 12 can be affixed to the bottoms of side panels 17, 18 and end panels 19, 20 of the sleeve or band 15, as seen in FIG. 6. Securing element 12 at bottom portion 36 of sleeve 15 can be the same dimensions and strength of the securing element 12 at the top portion 21. Securing, gripping, or positioning element 12 can preferably be about ¼-½ inch thick. Securing element 12 is preferably secured around the entire periphery 48 of the mattress 11. The securing element 12 is preferably used to facilitate and secure fitted and/or flat bed sheets 14 on a mattress 11, and preferably hold the sheets 14 in place without need for tucking them under the mattress 11.

In some embodiments, the securing, gripping or positioning element 12, e.g., an elastic portion, can extend along an entire width and/or length of a side panel 17, 18, and/or end panel 19, 20. In some embodiments, securing element 12 can be positioned at or near a bottom portion 21 and/or at or near a top portion of side panels 17, 18, or end panels 19 and 20. A securing element 12 can also be placed in a middle portion of side panels 17, 18 or end panels 19, 20. In some embodiments, the securing, gripping or positioning element 12, e.g., an elastic portion, can extend along an entire width and/or length of mattress side portions 24, 25 and end portions 26, 27. In some embodiments, the securing, gripping or positioning element 12, e.g., an elastic portion, of sleeve or band 15 can extend along an entire width and/or length of corners or corner portions 34 of mattress 11. In some embodiments, securing element 12 of sleeve or band 15 can be positioned on a bottom portion and/or middle portion and/or top portion of mattress side portions 24, 25 and end portions 26, 27.

Figure 24:
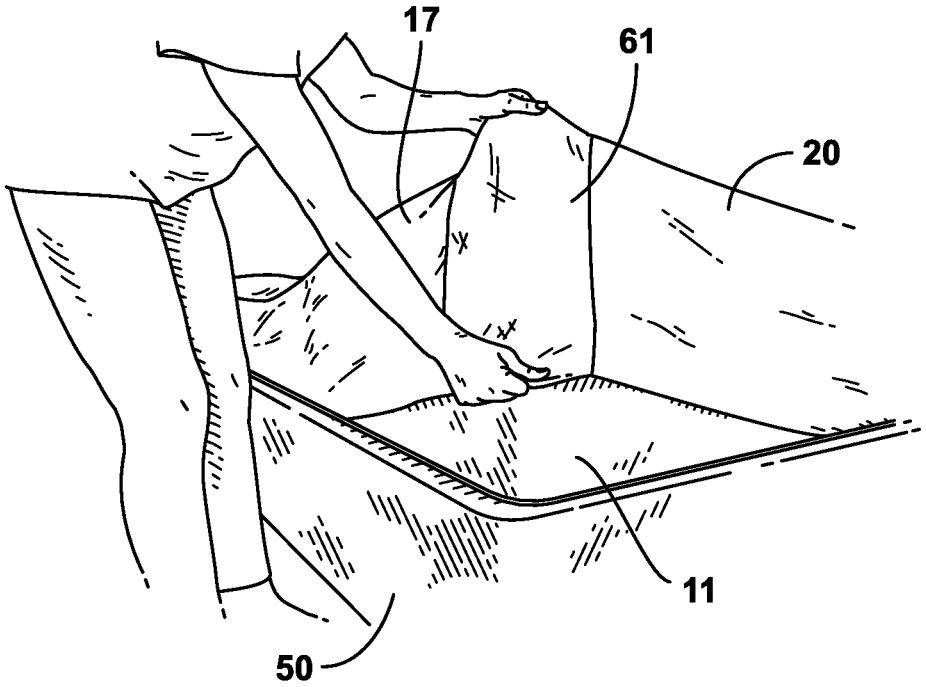
FIG. 24 is a partial perspective view of a method of the third preferred embodiment of the apparatus of the present invention, showing a step of placement of the apparatus on a mattress.

In a method of the present invention, sleeve 15 having side panels 17, 18, end panels 19, 20, and a securing, gripping or positioning element, e.g., an elastic piece 12 at the top perimeter or periphery of the sleeve 15, can be placed around mattress 11 side portions 24, 25, and end portions 26, 27, wherein the securing element 12 preferably rests below the top 28 of the mattress 11. The securing element 12 preferably positioned around the side portions 24, 25 and end portions 26, 27 of the mattress 11. Bedding/sheets 14 are preferably laid on top of the mattress top 28 and the ends of the sheets 14 are preferably tucked into the securing element 12 of sleeve 15. The securing element 12 is preferably of an effective compressive force to secure sleeve 15 to or against mattress 11 and secure bed sheets 14 on the mattress 11. The securing element 12 can be for example a sewing elastic. The securing element 12 can be sewn into sleeve 15. FIGS. 24, 25 show a sleeve 15 in a third preferred embodiment being placed on and/or around mattress 11, and sheets 14 laid on top of mattress 11 and tucked into sleeve 15. The method as shown in FIGS. 24 and 25 can also be used with the first and second preferred embodiments of a sleeve or band 15 as shown in FIGS. 1-6.

In one or more preferred embodiments, sleeve or band 15 can be positioned on mattress 11 preferably by being pulled onto the bottom portion 23 of a mattress 11 and covering the bottom portion 23, side portions 24, 25 and end portions 26, 27 of a mattress 11. In one embodiment, sleeve 15 can be positioned on mattress 11 preferably by being placed over mattress side 24, 25 and end 26, 27 portions, and preferably without covering mattress top 28 and bottom 23. In one embodiment, a portion of sleeve or band 15 panels (side panels 17, 18, end panel 19 which can be for a head of a bed, and end panel 20 which can be for a foot of a bed) can extend under the mattress 11. In one or more preferred embodiments, the sleeve side panels 17, 18, and end panels 19, 20 are preferably not limited to just positioning on the side portions 24, 25, head/end portion 26 and foot/end portion 27 areas of mattress 11.

The top 28 of the mattress 11 is preferably not covered by sleeve or band 15. The sleeve side panels 17, 18 and sleeve end panels 19, 20 preferably rise to a point near the top 28 of mattress 11, as seen in the figures. The sleeve top edge 21 preferably sits below the mattress top edge 31. Bed mattresses 11 can include cording 29 that surrounds top edge or edge portion 31 of the mattress 11, wherein the sleeve 15 preferably sits below the cording 29 as seen in FIGS. 3-6, for example. Sleeve top edge 21 preferably sits about 1 inch below the mattress top 28. Sleeve top edge 21 more preferably sits about ½ inch below the mattress top 28. Sleeve top edge 21 most preferably sits about ¼ inch below the mattress top 28. In other embodiments, sleeve top edge 21 can be positioned at any desired location along a mattress 11 side portion 24, 25 or end portion 26, 27. In some embodiments, sleeve top edge 21 can be positioned at or about in the middle of side portion 24, 25 or end portion 26, 27 of mattress 11.

In one or more preferred embodiments, each sleeve side panel 17, 18 can preferably have a magnet or magnetic material 13 as seen in FIGS. 1 and 10 on side panels 17, 18, e.g., sewn into side panels 17, 18. Sleeve or band 15 can grip bed sheets 14 in place on mattress 11 preferably with magnets 13 on the sleeve panels 17, 18 and on the mattress side portions 24, 25. The magnet or magnetic material 13 can be positioned at various locations on the side panel 17, 18. Preferably the magnet or magnetic material 13 can be positioned at or about a mid-point 30 on the side panels 17, 18 (see FIG. 1). A magnet or magnetic material 13 can be affixed on the mattress side portions 24, 25, preferably at corresponding locations to the locations of the magnet or magnetic material 13 on the sleeve panels 17, 18. The magnets 13 on sleeve side panels 17, 18 will preferably be attracted to the corresponding or mating magnets 13 on mattress side walls 24, 25. The magnet or magnetic material 13 can be positioned at various locations on the mattress side portions 24, 25. Preferably the magnet or magnetic material 13 can be positioned at a mid-point 30 on the mattress side portions 24, 25. In other embodiments a magnet system 49 including magnets or magnetic material 13 can be placed at any desired location on the sleeve side panels 17, 18, and/or sleeve end panels 19, 20, and/or mattress side portions 24, 25 and/or mattress end portions 26, 27, and/or mattress corner portions 34. The magnet system 49 can allow the bed sheets 14 to be tucked in between the securing element 12 of sleeve or band 15 and mattress 11, and the bed sheets 14 can be further secured in place on mattress 11 by the magnetic force in between sleeve side panels 17, 18 and mattress side portions/wall 24, 25.

Referring now to a second preferred embodiment, a sleeve or band device/system/apparatus designated generally by the number 55 is shown in FIGS. 3-6. A sleeve device 55 can be similar to a sleeve device 10 and can be used in a same or similar manner as a sleeve device 10 and includes securing, gripping or positioning elements/fastener 32.

In the second preferred embodiment sleeve device/system/apparatus 55 includes a sleeve 15 that also includes a securing, gripping, or positioning element 32 at or near corners or corner portions 33 that helps grip the sleeve 15 to the mattress 11 and/or hold the sleeve 15 in place on the mattress 11. The securing, gripping or positioning element 32 can be elastic. The gripping element 32 can also be a draw string or other fastener that preferably has gripping force or that can be tightened to apply force to hold sheets 14 in place on the mattress 11.

In one or more embodiments, the one or more gripping elements 32 can be provided on one or more sleeve corners 33 for preferably allowing sleeve or band 15 to be adjustable to the mattress 11 size, as seen in FIGS. 3-6. Sleeve 15 can be secured to mattress 11 with gripping elements 32 preferably on sleeve corners 33. The gripping elements 32 are preferably adjusted at the first time sleeve or band 15 is placed on mattress 11. In one or more preferred embodiments, the sleeve gripping elements/fasteners 32 can include a pull cord mechanism, hook and loop straps (e.g., Velcro® straps) 41, 42, grommets 47, button holes or some other fastening mechanism on the sleeve side panels 17, 18, and/or end panels 19, 20. The gripping elements 32 can be located at or around one or more sleeve corners 33, on the sleeve side panels 17, 18, sleeve end/head panel 19, and/or sleeve end/foot panel 20. The gripping elements 32 preferably allow for elastic, cord, hook and loop fastener or fabric used with gripping elements 32 to be pulled and tightened and preferably to be affixed either at all or some of the sleeve corners 33, or somewhere along the sleeve side panels 17, 18, sleeve head/end panel 19 or sleeve foot/end panel 20, at or near top 28 of mattress 11, as seen in FIGS. 3-6.

In one or more embodiments, sleeve panels (sides 17, 18, head/end 19, foot/end 20) can be four separate panels or pieces of material. In one or more embodiments, the sleeve side panels 17, 18, and end panels 19, 20 can be combined into one, two, or three pieces of material. In one or more embodiments, the sleeve or band 15 can be made of one continuous piece of fabric.

In one or more embodiments, the sleeve bottom panel 16 can be unaffixed to one or more sides portions 24, 25 or end portions 26, 27 of the mattress 11. In one embodiment, the sleeve bottom panel 16 can be affixed to one or more side portions 24, 25, or end portions 26, 27 of mattress 11.

In one or more embodiments, there can be hard pieces, grip pads, or other non-slip material preferably affixed to sleeve 15 to prevent sliding on either inside or outside of the sleeve 15 preferably at the sleeve corners 33, at or about at mid-points of sleeve side panels 17, 18, or end panels 19, 20 or at other desired positions on the sleeve 15. Preferably affixed non-slip material in the inside of the one or more sleeve corners 33 would keep the corner(s) 33 in place on mattress 11.

In one or more embodiments, there can be hard pieces, grip pads, or other non-slip material preferably affixed to sleeve or band 15 to prevent sliding either inside or outside of sleeve or band 15 at any place on the material of sleeve or band 15. Preferably, non-slip material can be affixed to sleeve or band 15 to keep sleeve or band 15 under a mattress 11 and from sliding out.

In one or more embodiments, the present invention provides that bedding sheets 14 can be applied and removed from a mattress 11 without lifting mattress 11, and because of the securing, gripping, or positioning element 12, e.g., elastic or other suitable securing element, preferably positioned below the top edge 31 of mattress 11, the possibility of ripping or tearing of sheets 14 is reduced substantially.

In one or more embodiments, a sleeve or band 15 also helps prevent sheets from popping off the mattress or from becoming baggy around the mattress, or substantially reduces the same.

One or more embodiments of the present invention can be used in homes, hospitals, hotels, dormitories, camps, nursing homes, and other locations that require bedding sheets to be removed and changed frequently.

The sleeve or band 15 in one or more embodiments of the present invention can also be used to hold objects on the side of a bed 50 or mattress 11, such as a cell phone, book or other personal items. In one or more embodiments, there can be one or more pockets 37 on the inner side of one or more of the sleeve side panels 17, 18, or end panels 19, 20 (see FIG. 1). In one or more embodiments, there can be one or more pockets 37 on the outer side of one or more of the sleeve side panels 17, 18, or end panels 19, 20.

Sleeve or band 15 in one or more embodiments of the present invention preferably uses a combination of elastic force and friction to hold the bed sheets 14 or other linens or bed covers on mattress 11, preferably at the four mattress corners 34. Sleeve or band 15 uses the force of the securing, gripping, or positioning element 12, e.g., elastic or other suitable securing element, around the mattress side 24, 25 and end 26, 27 portions to preferably hold the bed sheets 14 against the mattress side 24, 25 and end 26, 27 portions. The apparatus and method of the present invention simplifies the process of putting new or fresh sheets 14 on ("changing the sheets") or tidying up the sheets 14 after use ("making the bed").

The sleeve or band 15 in one or more embodiments of the present invention preferably attaches to the outer side of the bedding fabric 14 and then preferably a force, such as elastic or magnetic, holds sleeve or band 15 against the mattress 11, preferably at least at each of the four mattress corners 34. Optionally, a magnet system, e.g., with magnets 13, can be used to secure sleeve or band 15 to the mattress 11, wherein sleeve or band 15 is preferably affixed to both sides of the fabric.

The sleeve or band 15 in one or more embodiments preferably does not include a top portion that extends along top 28 on the mattress 11. The sleeve or band 15 is preferably kept off the mattress top 28 so that sleeve or band 15 is preferably not slept on and therefore does not have to be washed with the bed sheets 14.

The sleeve or band 15 in one or more embodiments preferably keeps the bed sheets 14 tucked in on the sides 24, 25 of the mattress 11 and does not require that the bed sheets 14 be pushed under the bottom 23 of the mattress 11. This simplifies the process of changing sheets 14 as well as making a bed.

In various embodiments, the sheet or band device/apparatus/system 10, 55, 60 with a sleeve or band 15 can be manufactured as part of a mattress 11.

In various embodiments, a securing, gripping, or positioning element 12, e.g., elastic or other suitable securing element, can be included at or near the bottom edge 36 of the sleeve or band 15.

In various embodiments, one or more securing elements 35 with gripping force, such as for example elastic straps or other suitable securing elements, can be affixed to a side sleeve panel 17, extend to and across the bottom 23 of the mattress 11, and be affixed to the opposite side sleeve panel 18, as seen in FIG. 6.

In various embodiments, one or more securing elements 35 with gripping force, such as for example elastic straps or other suitable securing elements, can be affixed to the head/end 19 or foot/end 20 sleeve panel, extend across the bottom 23 of the mattress 11, and be affixed to the opposite head/foot/end sleeve panel 19, 20, as seen in FIG. 6.

In various embodiments, one or more securing elements 35 with gripping force, such as for example elastic straps or other suitable securing elements with gripping force, can be affixed to the sides 17, 18, head/end 19, and foot/end 20 sleeve panels as seen in FIG. 6. In some embodiments, the one or more securing elements 35 can be covered with a fabric panel.

In other embodiments, securing elements 35 are not included in a sleeve or band device/apparatus/system 10, 55, 60, with bottom portion 16 of sleeve or band 15 being tucked under bottom 23 of mattress 11. In other embodiments, a bottom portion 16 of sleeve or band 15 is not included in a sleeve or band device/apparatus/system 10, 55, 60, wherein the sleeve or band 15 does not extend to bottom portion 23 and/or does not extend below bottom portion 23 of mattress 11.

Referring now to FIGS. 7-9, 11-25, a third preferred embodiment is shown. In FIGS. 7-9, 11-23, a sleeve or band device, system, apparatus and method is designated generally by the number 60. A sleeve or band device, system, apparatus and method 60 can include a similar sleeve 15 as described with regard to the embodiments designated by numerals 10 and 55 and include reinforcing portions 61 and can be used in a same or similar manner as the embodiments designated generally by the numbers 10 and 55.

Figure 22:
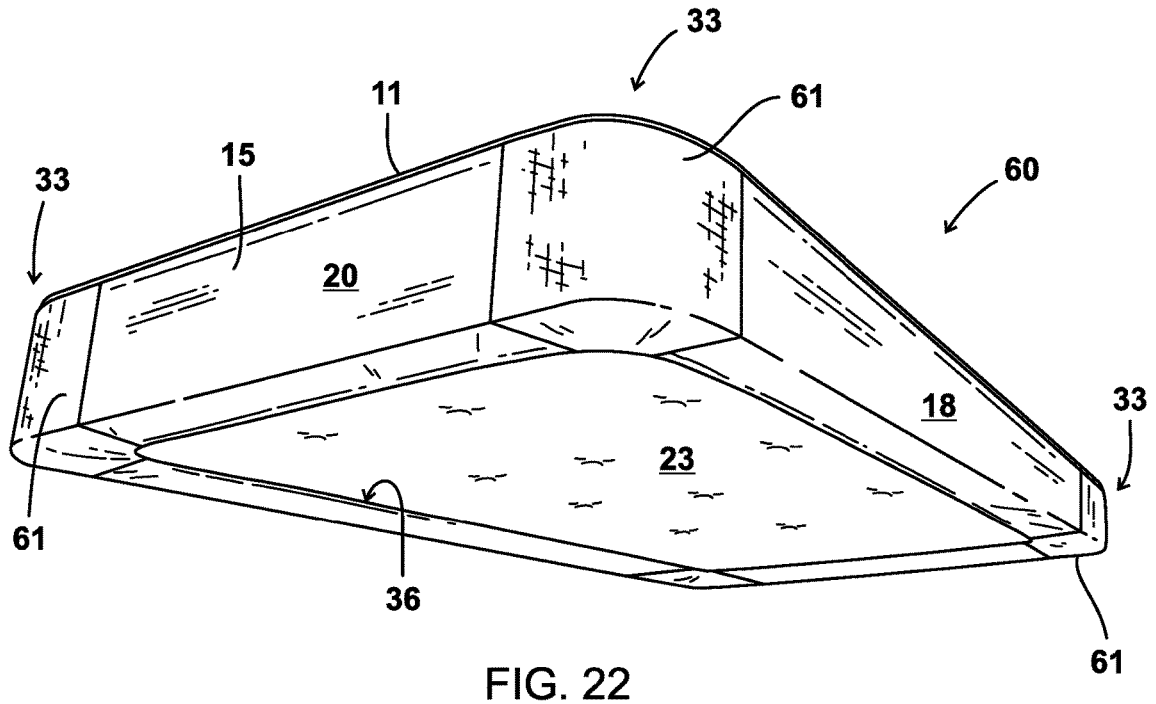
FIG. 22 is a bottom perspective view of the third preferred embodiment of the apparatus of the present invention, showing a mattress with attached sleeve and including a bottom portion extending under the mattress.

Similarly to the embodiments of FIGS. 1-6, a sleeve or band device 60 includes a sleeve 15 preferably having side panels 17, 18, end panels 19, 20, and also includes corner reinforcer pieces/portions/layers 61 that can form a corner or corner portion 33. In various embodiments, the sleeve or band 15 can have a bottom panel 16, e.g., as shown in FIG. 22 wherein bottom panel 16 can be tucked under mattress 11 bottom portion 23 and wherein bottom panel 16 does not extend across the entire mattress bottom portion 23. In various embodiments, the sleeve or band 15 does not have a bottom panel 16 and ends at sleeve bottom edge 36. Bottom panel 16 or sleeve bottom edge 36 can extend as much or as little as there is excess material near mattress bottom 23. For example, if mattress 11 is short in height, then panel 16 or edge 36 can extend one or more inches to fully cover under mattress bottom 23. If the mattress is tall in height, there may be about an inch or possibly none of the panel 16 or edge 36 to tuck under mattress 11.

Figure 18:
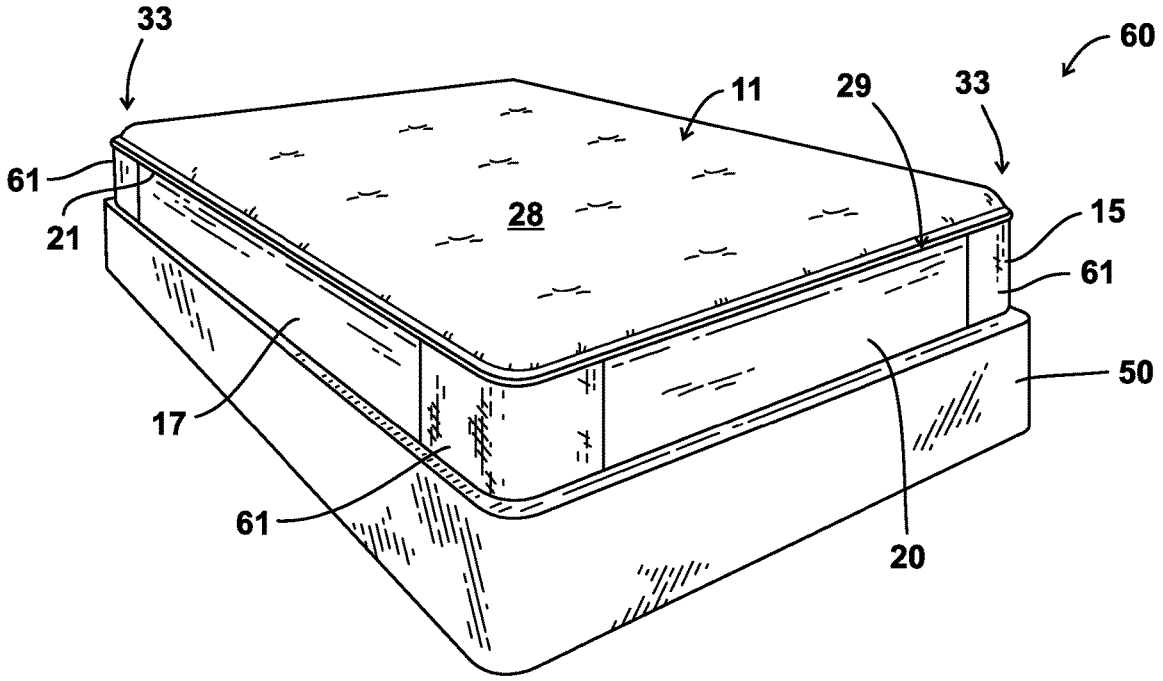
FIG. 18 is a perspective view of the third preferred embodiment of the apparatus of the present invention, showing a mattress with attached sleeve/band and including a bottom portion extending under the mattress.
Figure 20:
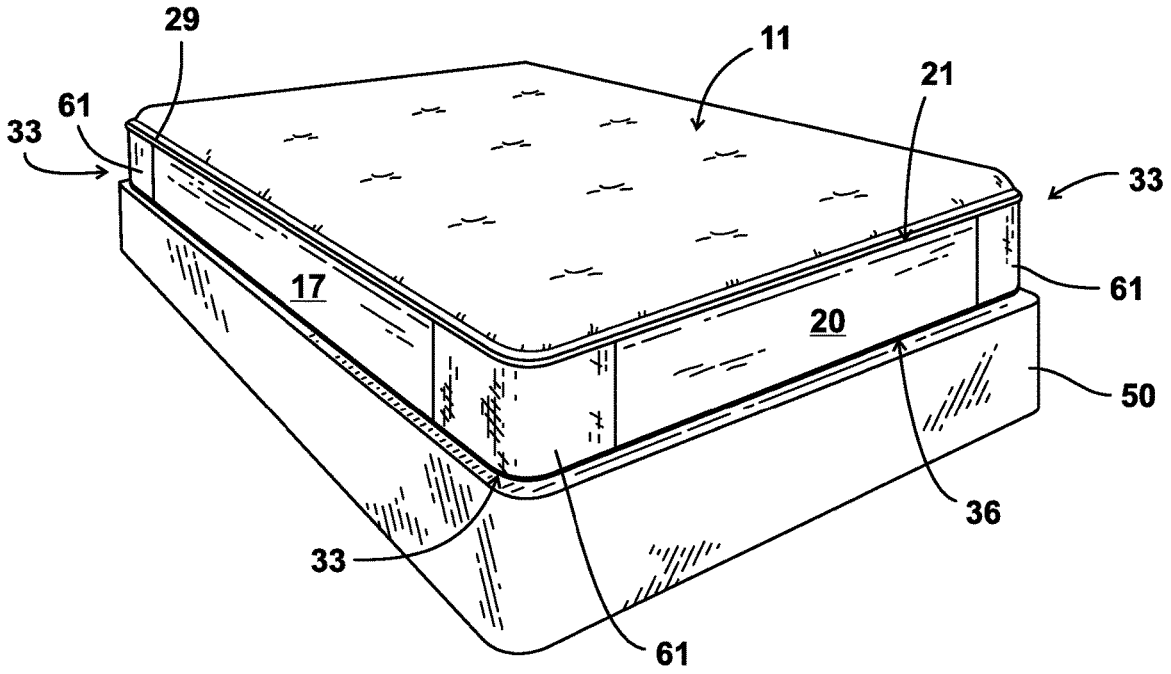
FIG. 20 is a perspective view of the third preferred embodiment of the apparatus of the present invention, showing a mattress with attached sleeve/band and not including a bottom portion extending under the mattress.
Figure 21:
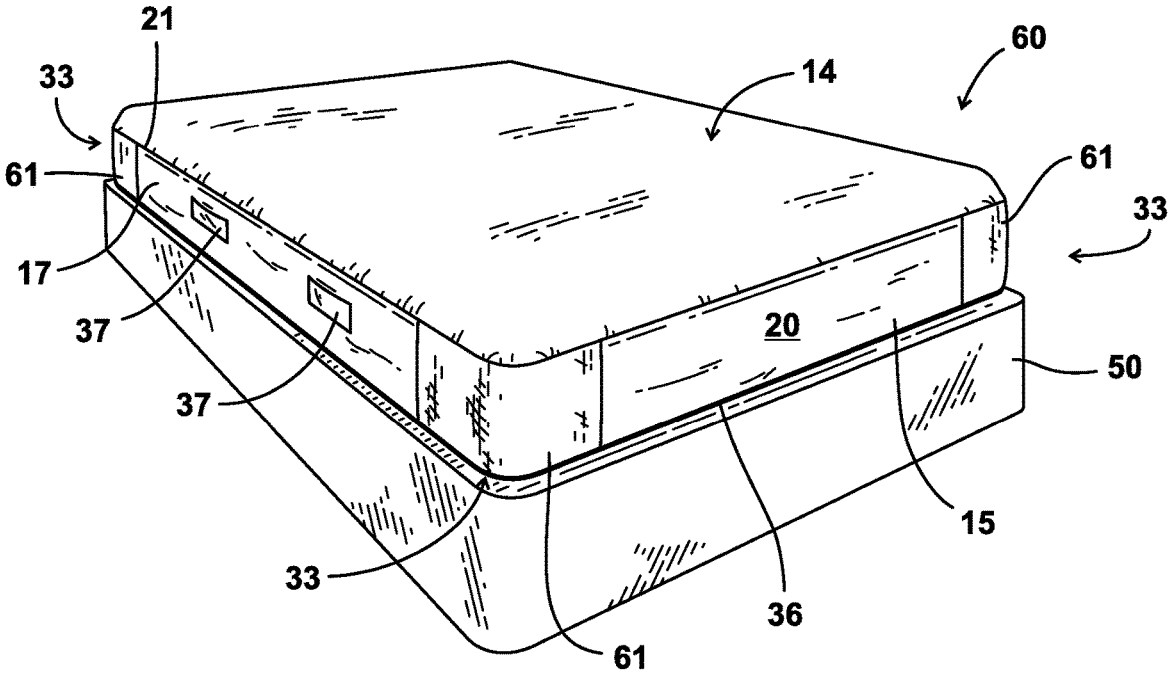
FIG. 21 is a perspective view of the third preferred embodiment of the apparatus of the present invention, showing a mattress with attached sleeve and sheets and further including side pockets and not including a bottom portion extending under the mattress.
Figure 23:
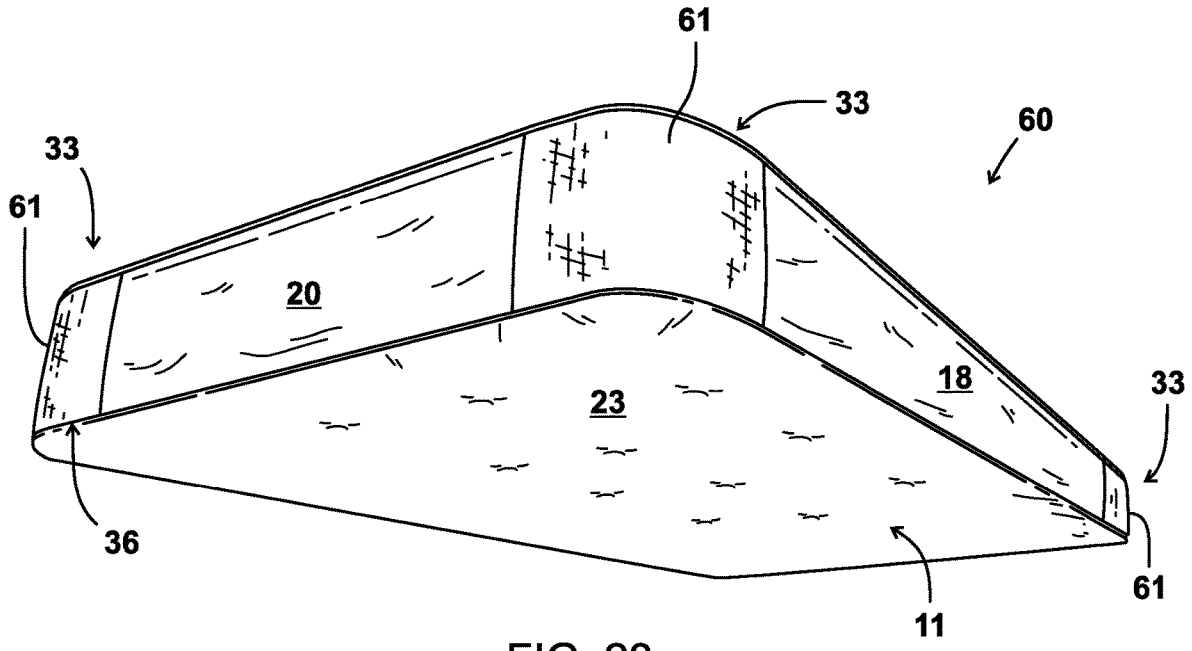
FIG. 23 is a bottom perspective view of a third preferred embodiment of the apparatus of the present invention, showing a mattress with attached sleeve and not including a bottom portion extending under the mattress.

In various embodiments, the sleeve or band 15 does not have a bottom panel 16, e.g., as seen in FIG. 23. In a preferred embodiment, the sleeve 15 includes side panels 17, 18 and at least one end panel 19, 20, and does not have a bottom panel 16. If sleeve 15 does have a bottom panel 16, preferably the sleeve bottom panel 16 can be a thinner material than the other sleeve side panels 17, 18, and end panels 19, 20. In various embodiments, sleeve bottom edge 36 can be positioned above the mattress bottom edge as seen in FIGS. 20, 21, 23. In various embodiments, sleeve bottom edge 36 can extend below the mattress bottom edge and be positioned under mattress 11 as seen in FIGS. 18, 19, 22.

Sleeve 15 of a sleeve or band device/apparatus/system 60 can be comprised of eight (8) separate pieces/parts of fabric material, including the side 17, 18 and end 19, 20 panels and four corner reinforcing pieces 61 that form sleeve or band 15. Each piece 17-20, 61 of sleeve or band 15 can be rectangularly-shaped and preferably sewn together to create a continuous band of fabric that is placed around and secured to or against mattress side portions 24, 25, and end portions 26, 27. In various embodiments, sleeve or band 15 can be comprised of a single continuous piece or band of fabric/material that is placed around and secured to or against mattress side portions 24, 25, and end portions 26, 27.

Figure 19:
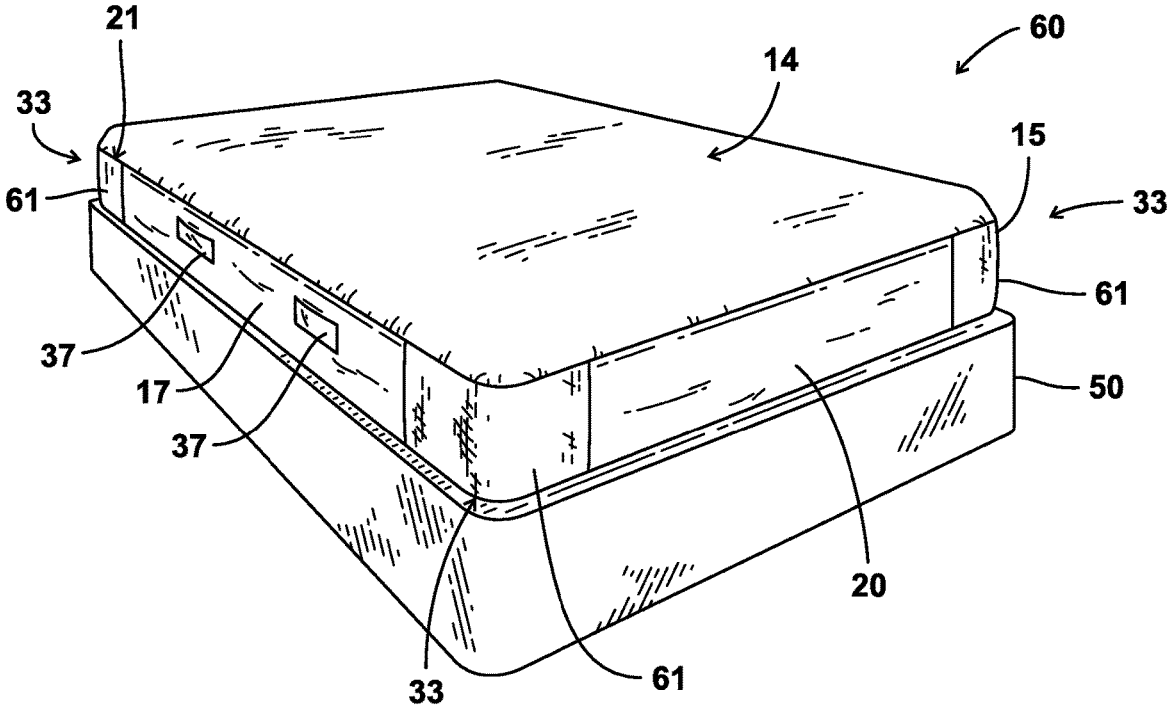
FIG. 19 is a perspective view of the third preferred embodiment of the apparatus of the present invention, showing a mattress with attached sleeve/band and sheets and further including side pockets and including a bottom portion extending under the mattress.

As shown in FIGS. 19, 21, pockets 37 can be included on sleeve or band 15 of the third preferred embodiment, e.g., for holding or storing a cell phone, book, glasses, or other desired object. Pockets 37 can be included in one or more preferred embodiments as described and shown herein.

A sleeve corner reinforcing piece 61 is preferably positioned in between respective junctions of a sleeve side panel 17 or 18 with a sleeve end panel 19 or 20, as seen in FIGS. 7-9 and 11, and sleeve corner reinforcing piece 61 forms corners 33 when on a mattress 11 and preferably pulls and tightens sleeve side panels 17, 18, and end panels 19, 20 in between corner reinforcing pieces 61 and around the mattress sides portions 24, 25, and end portions 26, 27. Preferably, corner reinforcing pieces 61 can be made of a material that stretches and secures the corner reinforcing pieces 61 to the mattress side portions 24, 25, and end portions 26, 27, such as a stretch or knit fabric, for example, such as about 82% nylon and about 18% Lycra, spandex, elastane. Preferably, sleeve corner reinforcing pieces 61 can be about 2-16 inches in length and about 5-20 inches in height. More preferably, sleeve corner pieces can be about 9 inches in length and about 16 inches in height.

Similarly to the other preferred embodiments, sleeve 15 is preferably made of a fabric material, such as for example elastic and/or spandex, cotton, polyester, neoprene or other desired material or a combination of one or more of the aforementioned materials. Sleeve side panels 17, 18 and end panels, 19, 20 can be made of an elastic material and/or of spandex, cotton, polyester, neoprene or other synthetic or natural material, and/or of a combination of one or more of the aforementioned materials. Sleeve side panels 17, 18 and end panels, 19, 20 can be made of one or more types of material currently known, or to be developed in the future, that provide stretch, elastic and/or flexible force. Sleeve side panels 17, 18 and end panels, 19, 20 can also be made of inelastic, woven material, such as cotton, linen, linen-blend, light weight twill, denim, or any other suitable material or a combination thereof.

In a preferred embodiment, corner reinforcing pieces 61 can be made of a material that stretches and secures the corner reinforcing pieces 61 to the mattress side portions 24, 25, and end portions 26, 27, such as a stretch or knit fabric, for example, such as about 82% nylon and about 18% Lycra, spandex, elastane and sleeve side panels 17, 18, and end panels, 19, 20 can be made of inelastic, woven material, such as cotton, linen, linen-blend, light weight twill, denim, or any other suitable material or a combination thereof. In this embodiment, sleeve corner reinforcing pieces 61 can be about 2-16 inches in length and about 5-20 inches in height. More preferably, sleeve corner pieces can be about 9 inches in length and about 16 inches in height. In this embodiment, preferably, sleeve side panels 17, 18 can be about 59-68 inches in length; and about 5-20 inches in height. Preferably, sleeve end panels 19, 20 can be about 23-60 inches in length; and about 5-20 inches in height. Preferably, corners/corner portions 33 can be about 9-13 inches in length; and about 5-20 inches in height.

Figure 8:
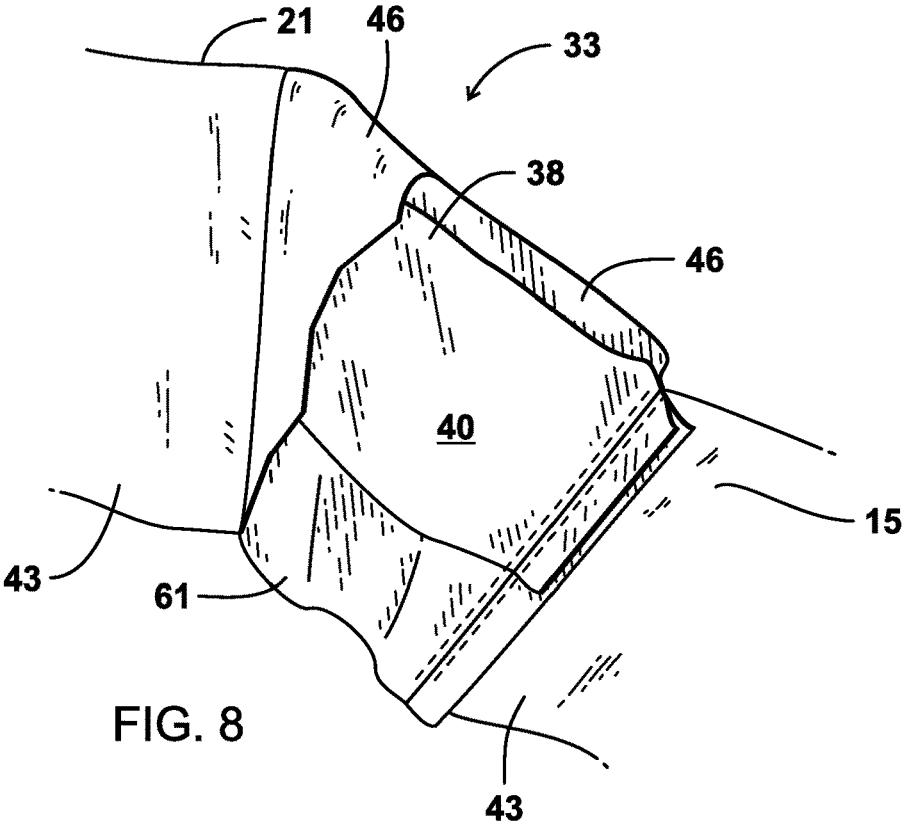
FIG. 8 is a fragmentary view of the third preferred embodiment of the apparatus of the present invention, showing a corner construction.
Figure 9:
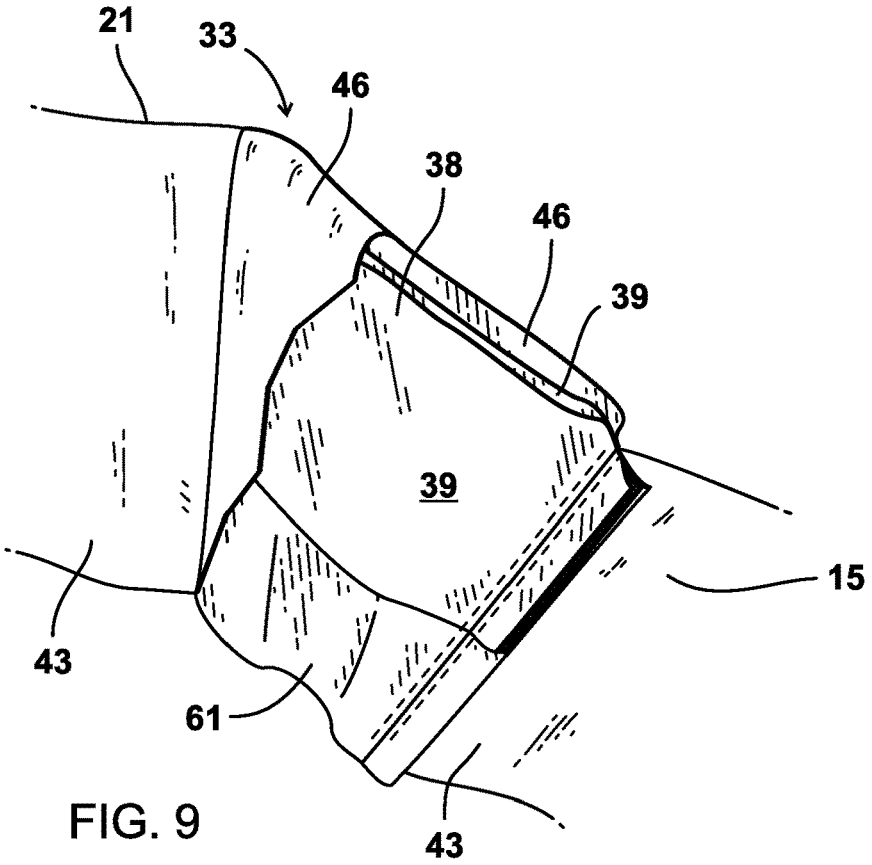
FIG. 9 is a fragmentary view of the third preferred embodiment of the apparatus of the present invention, showing a corner construction.
Figure 11:
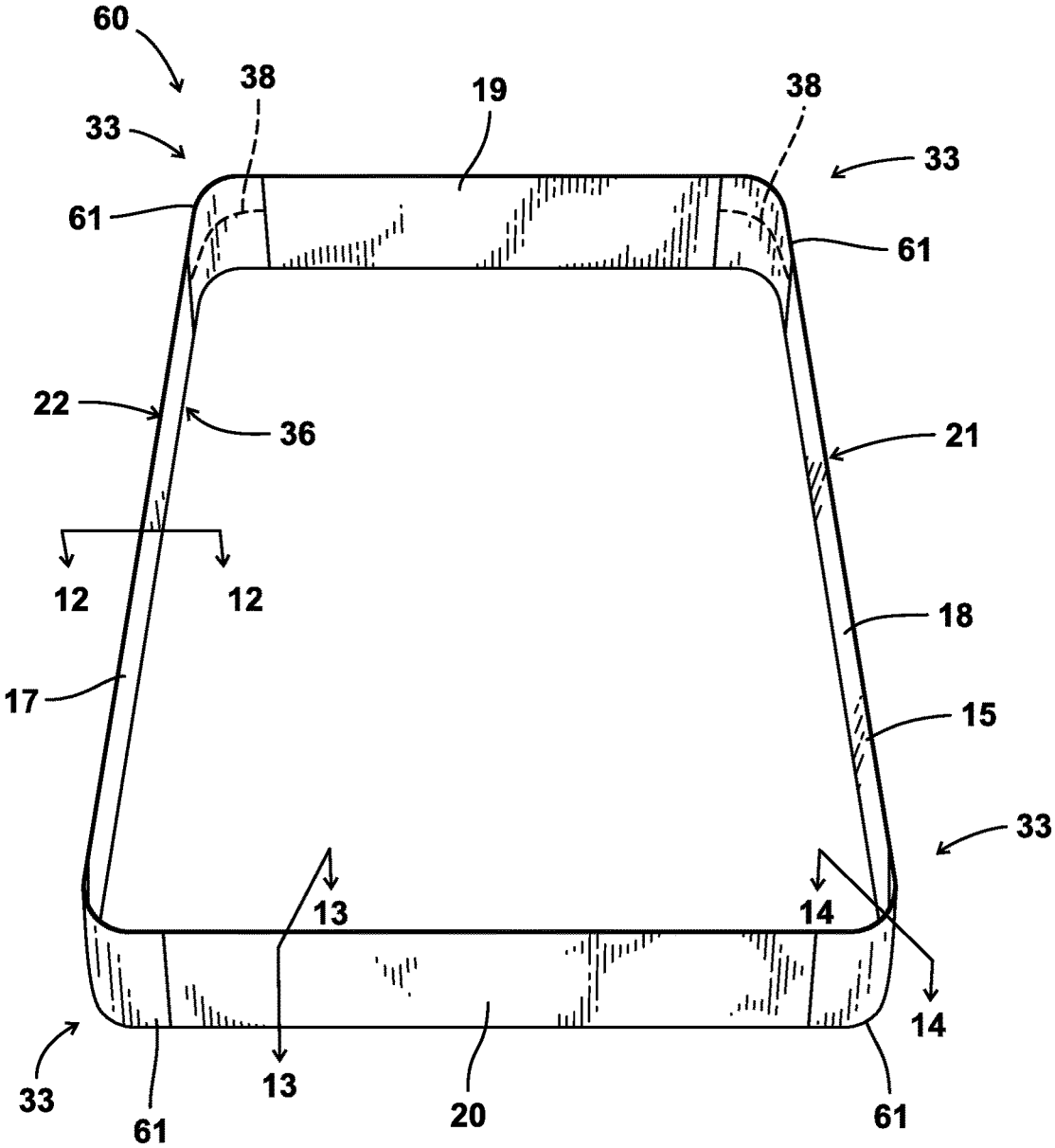
FIG. 11 is a top perspective view of the third preferred embodiment of the apparatus of the present invention.
Figure 12:
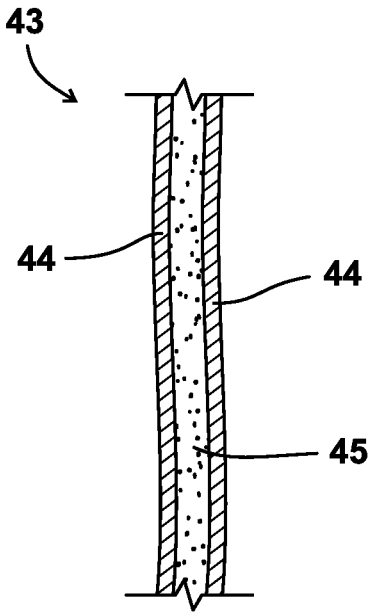
FIG. 12 is a sectional view taken along lines 12-12 of FIG. 11 of the third preferred embodiment of the apparatus of the present invention.
Figure 13:
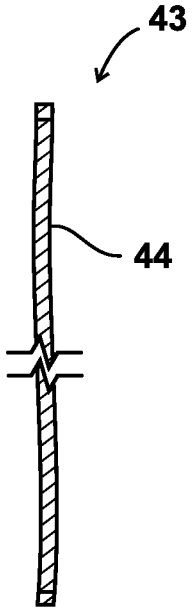
FIG. 13 is a sectional view taken along lines 13-13 of FIG. 11 of the third preferred embodiment of the apparatus of the present invention.

Sleeve side panels 17, 18 and end panels, 19, 20 are preferably a double layer of fabric 44, and preferably including a filling 45, such a batting (i.e., soft, thick material used as a lining or a layer of insulation between a top layer and a bottom layer, e.g., batting used in quilts), in between the double layers of fabric 44 as seen in FIG. 12. A preferred construction of double layered fabric 44 and batting/filling 45 provides a clean or smooth appearance of the sleeve side panels 17, 18 and end panels, 19,20 when bed sheets 14 are tucked into the sleeve 15. One or more sleeve side panels 17, 18 and end panels, 19, 20 can be a double layer of fabric 44, and preferably including a filling 45, such a batting. Alternatively, one or more sleeve side panels 17, 18 and end panels, 19, 20 can be a single layer of fabric 44, as seen in FIG. 13. Preferably the side panels 17, 18 can be a double layer of fabric 44, and preferably including a filling 45, such a batting, as seen in FIG. 12. Preferably the end panels 19, 20 can be a single layer of fabric 44, as seen in FIG. 13. In the third preferred embodiment, preferably, side 17, 18 and end 19, 20 panels can be of a different material than corner reinforcing pieces 61. Corner reinforcing pieces 61 are made of a corner layer/fabric/material 46, which preferably is one to two-ply (two sheets or layers thick of fabric) material that are coupled to one another and to a respective sleeve side/end panel 43, which can be a side panel 17, 18 or end panel 19, 20, as shown in FIGS. 8-9, 11. In a preferred embodiment, corner reinforcing pieces 61 further include an additional corner layer/corner securing layer or section 38 that is preferably a securing, gripping or positioning layer and positioned at or near top edge or top portion 21 of sleeve or band 15, as seen in FIGS. 8-9, 11, 14-17. The additional corner layer 38 can be about 1-6 inches in width and about 16 inches in length. Preferably, the additional corner layer 38 can be about 3 inches in width and about 16 inches in length.

Figure 14:
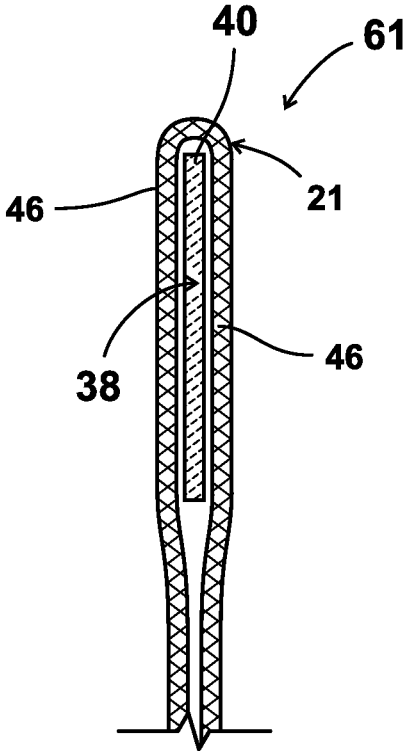
FIG. 14 is a sectional view taken along lines 14-14 of FIG. 11 of the third preferred embodiment of the apparatus of the present invention.
Figure 15:
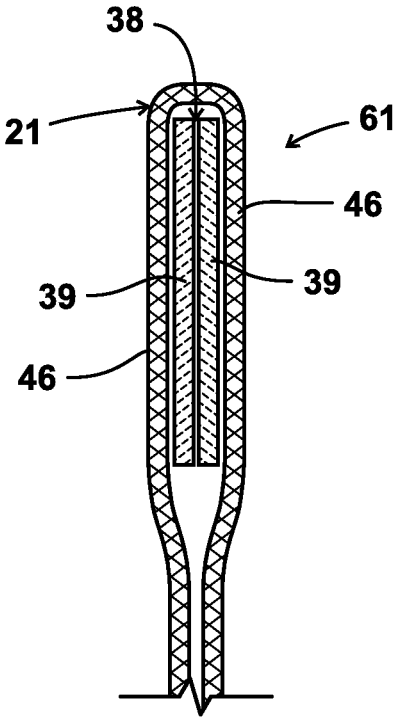
FIG. 15 is an alternative sectional view taken along lines 14-14 of FIG. 11 of a third preferred embodiment of the apparatus of the present invention.
Figure 16:
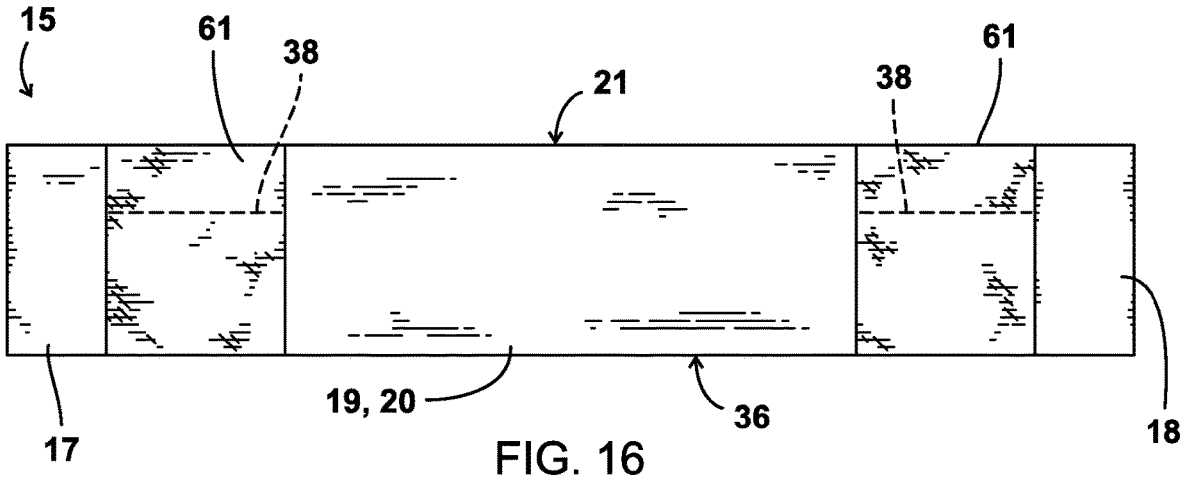
FIG. 16 is a side view of the third preferred embodiment of the apparatus of the present invention.
Figure 17:
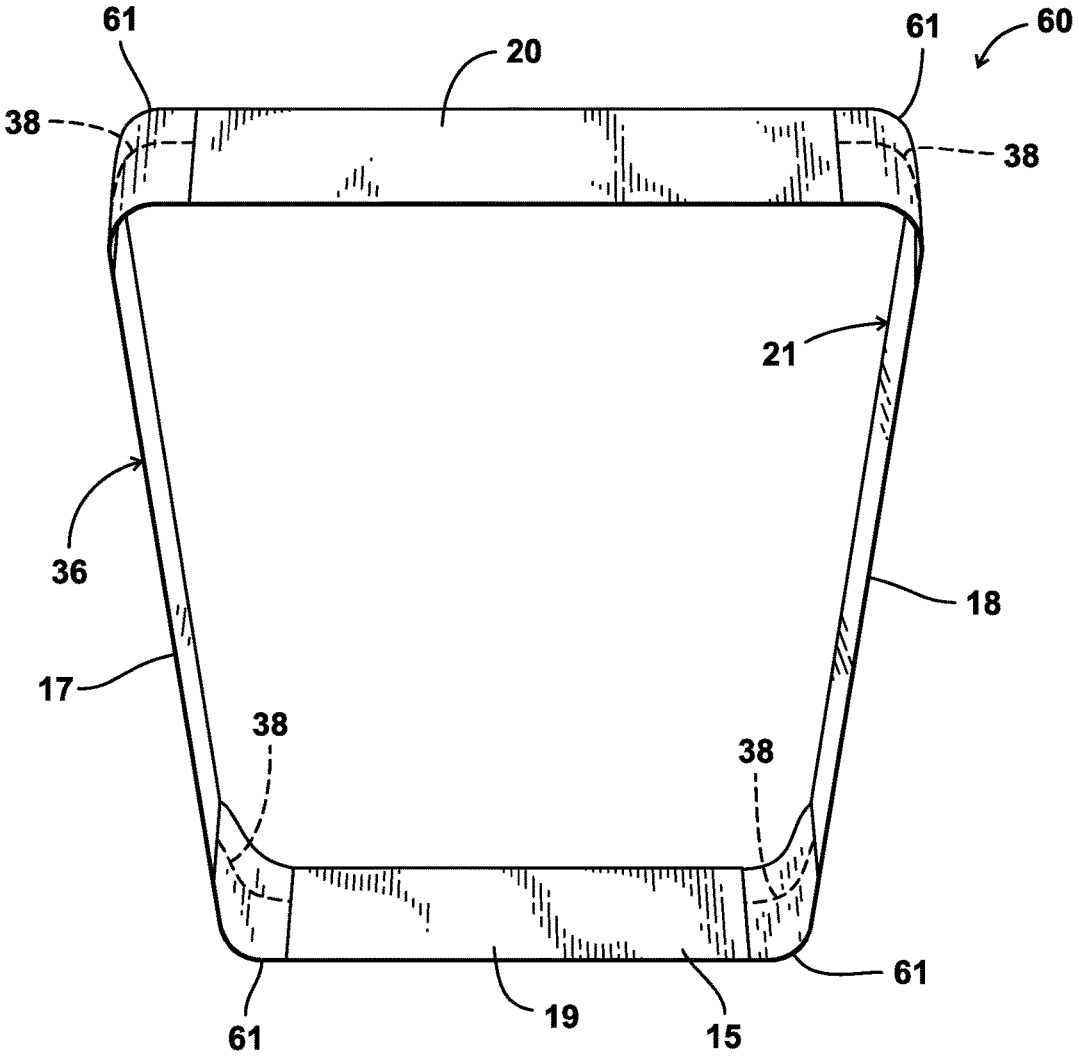
FIG. 17 is a bottom perspective view of the third preferred embodiment of the apparatus of the present invention.

In one or more embodiments, the additional corner layer 38 can include two-ply layer/double-layers 39, which can be double ply knit fabric layers or double ply stretch layers, positioned at or near the top edge 21 of the sleeve 15, preferably creating a section/strip of the corner 33 with corner reinforcing piece 61 being made up of four layers as seen in FIG. 9. Alternatively, in another preferred embodiment, the additional layer 38 can include an elastic layer 40 positioned at or near top edge/top portion 21 of the sleeve or band 15 as seen in FIGS. 8, 14 instead of an additional two-ply layer 39. Alternatively, in another preferred embodiment, the additional corner layer 38 can include an additional elastic layer 40 and an additional two-ply layer/double layer 39.

Fabric 44 for sleeve side 17, 18 and end 19, 20 panels can be commercially available material, for example Fabricdirect.com Wholesale 102" Percale—Sheeting Fabric White 50-yard roll. Corner layer/fabric/material 46 for reinforcing pieces 61 of corners/corner panels 33 can be commercially available material, for example Top Value Fabrics/Shelly #103166 62/63 10.3 oz 88/12 Polyester/Spandex Double Circular Knit, Wicking Finish White. Corner layer/corner securing layer or section 38 can be commercially available material, preferably for example WBC Industries 3 inch #white woven elastic ITEM #191/3W. Corner layer/corner securing layer or section 38 can also be for example WBC Industries #330/3W Knitted Elastic White 3".

Like other embodiments shown in FIGS. 1-6, sleeve or band 15 of device 60 can have a top portion or top edge 21 with a periphery 22. In one embodiment, top edge 21 can include a securing, gripping, or positioning element(s) 12, e.g., elastic or other suitable securing element, positioned at the top portion or top edge 21. In various embodiments, the securing, gripping, or positioning element 12, e.g., elastic or other suitable securing element, can be included at or near the bottom edge 36 of the sleeve or band 15. Sleeve or band 15 can be wrapped around the side portions 24, 25 and end portions 26, 27 of a mattress 11. In various embodiments, sleeve or band 15 can also cover mattress bottom portion 23 or extend under a portion of mattress bottom portion 23.

In preferred embodiments, sleeve bottom edge 36 does not include a securing element and is a free edge. When sleeve or band 15 is secured to mattress 11, the free bottom edge 36 of sleeve or band 15 can be tucked under mattress 11. In another embodiment, the free bottom edge 36 can stay untucked and extend below mattress bottom portion 23, such as for example like a bed skirt. In another embodiment, sleeve bottom edge 36 can be position above the mattress bottom portion 23 or a mattress bottom edge.

Sleeve or band 15 of a sleeve or band device/apparatus/system 60 can be made to any suitable size to fit a mattress 11 size. For example, a mattress 11 can be between 5-20 inches in height, depending on the type and thickness of the mattress 11. Sleeve or band 15 can be used on mattresses for all kinds of beds, including bunk beds. Sleeve or band 15 of the present invention is preferably sized and shaped to fit any mattress size that is currently on the market. Sleeve or band 15 can preferably be sized and shaped to be used with any bedding sheets or linens that are currently on the market. Sleeve 15 preferably does not require any alteration to be used with existing fitted sheets or flat sheets that are currently on the market. Preferably sleeve 15 can also be sized for use with custom mattresses and sheets and/or mattresses and sheets to be developed in the future.

Preferably, sleeve side panels 17, 18 can be about 59-68 inches in length; about 5-20 inches in height. Preferably, sleeve end panels 19, 20 can be about 23-60 inches in length; about 5-20 inches in height. Preferably, corners/corner portions 33 can be about 9-13 inches in length; about 5-20 inches in height. The following table shows different preferred sizing (in inches) of sleeve 15 pieces/portions:

| Mattress Size (Width × Length) | Twin- 39 × 75 | Full- 54 × 75 | Queen- 60 × 80 | King- 76 × 80 | California King- 72 × 84 | Extra Large Twin- 38 × 80 |
|---|---|---|---|---|---|---|
| Side Sleeve, 17, 18 (Length × Height) | 59 × 16 | 59 × 16 | 64 × 16 | 64 × 16 | 68 × 16 | 64 × 16 |
| Head & Foot Sleeve, 19, 20 (Length × Height) | 23 × 16 | 38 × 16 | 44 × 16 | 60 × 16 | 56 × 16 | 22 × 16 |
| Corners, 33, Double-ply (Plus 3" wide elastic and/or additional double-ply at top 3" × 16") (Length × Height) | 9 × 16 | 9 × 16 | 9 × 16 | 9 × 16 | 9 × 16 | 9 × 16 |

In a method of the present invention using a device/apparatus/system 60, a sleeve 15 having side panels 17, 18, end panels 19, 20, a plurality of corner reinforcing pieces 61 with a corner securing portion or layer 38, preferably provided at or near the top of each corner piece 33, can be placed around mattress 11 side portions 24, 25 and end portions 26, 27, wherein the corner pieces 33 and side panels 17, 18, and end panels 19, 20 preferably rest below the top portion or top 28 of the mattress 11 as seen in FIGS. 24, 25. Bedding/sheets 14 are preferably laid on top of the mattress top 28 and the ends of the sheets 14 are preferably tucked into sleeve panels 17, 18 in between mattress 11 and sleeve or band 15. The corner securing layer/portion 38 is preferably of an effective compressive force to preferably secure sleeve 15 to mattress 11 and secure bed sheets 14 on the mattress 11. The securing portion 38 can be for example double layer or two-ply fabric 39 or an elastic layer 40 (see FIGS. 8-9). The securing portion 38 can be sewn into corner pieces 33.

In one or more embodiments, the present invention can include an extension sleeve that can be provided below an existing sleeve 15 on a mattress 11. An extension sleeve can be used in combination with an existing sleeve 15 when existing sleeve 15 does not extend the full height of a mattress 11 to the mattress bottom 23.

As discussed in one or more preferred embodiments, the force of elastic or stretch material holds sheets to a mattress 11. In some embodiments, nothing else is holding the sheets to the mattress, just the force of the stretch or elastic. The stretch can be provided at one or more desired locations on a sleeve or band device 10, 55, 60. The stretch of the sleeve or band device 10, 55, 60 can be provided by one or more different materials. For example, if stretch is provided at corners 33 and side panels 17, 18 and/or end panels 19, 20 and/or at a bottom portion 16, the material of the corners 33 can be different from a material of a side panel 17, 18 and/or an end panel 19, 20 and/or of the bottom portion 16. The material of the side panels 17, 18 can be different from a material of an end panel 19, 20 and/or of a bottom portion 16. The material of an end panel 19, 20 can be different from a material of a side panel 17, 18 and/or of bottom portion 16.

When stretch force is used at more than one location, the amount of stretch force at any one location on a sleeve or band device 10, 55, 60 can be the same or different from the amount of stretch force at another location on the sleeve or band device 10, 55, 60. For example, the amount of stretch force at a corner 33 can be different from the amount of stretch force at a side panel 17, 18. The amount of stretch force at a corner 33 can be different from the amount of stretch force at an end panel 19, 20. The amount of stretch force at a corner 33 can be different from the amount of stretch force at a bottom portion 16. The amount of stretch force at a side panel 17, 18 can be different from the amount of stretch force at an end panel 19, 20 and/or a bottom panel 16. The amount of stretch force at an end panel 19, 20 can be different from the amount of stretch force at side panel 17, 18 and/or a bottom panel 16.

In testing, it has been found that stretch works best at corners 33 of a sleeve or band device 10, 55, 60. The stretch can be at corners 33 of the sleeve or band device 10, 55, 60 and not at other locations on the device. The stretch can also be at corners 33 of the sleeve or band device 10, 55, 60 and along side panels 17, 18 and/or end panels 19, 20 of the device or at other desired locations. Stretch can also not be at corners 33 of the sleeve or band device 10, 55, 60 and provided at other desired locations on the device.

An important notable difference in one or more embodiments of the present invention over the prior art is that the sleeve device uses a combination of elastic force and friction to hold one or more sheets to the mattress, preferably at the four corners.

An important notable difference in one or more embodiments of the present invention over the prior art is that one or more embodiments of a sleeve or band device of the present invention uses the force of an elastic band or band of other stretchy material around the periphery of the mattress to hold one or more sheets against the mattress itself.

Importantly, one or more embodiments of the present invention simplify the process of putting new sheets on ("changing the sheets") or tidying up the sheets after use ("making the bed").

Another important notable difference is that much of the prior art requires that a contraption affix itself to both sides of the bed sheets. The prior art contraptions such as a clamp, jaw or clip, attaches to the "outer side" of the fabric and "inner side" of the fabric at one or more points. One or more embodiments of the present invention attaches or is just held against the outer side of the fabric, and not the inner side of the fabric, and then the elastic force pushes it against the mattress, e.g., preferably at each of the four corners. An exception is for embodiments in which a magnet is used, in which case the magnet can be affixed to both sides of the fabric of a sleeve or band, or the magnet can be affixed to one side of the fabric of sleeve or band and another magnet can be affixed to the mattress.

Another important notable difference from the prior art is that one or more embodiments of the present invention intentionally exclude a top portion that would be placed on top of a mattress so that the device is not slept on and therefore does not have to be washed with the bed sheets.

Another important notable difference from the prior art is that one or more embodiments of the present invention does not require any alteration to the existing fitted sheets or flat sheets that are currently on the market. Existing fitted and/or flat sheets can be used with one or more embodiments of the present invention.

Another important notable difference from the prior art is that one or more embodiments of the present invention intentionally keeps the bedsheets on the sides of the mattress and does not require that the bedsheets be pushed under the bottom of the mattress. This simplifies the process of changing sheets as well as making the bed and avoids having to lift a having mattress to make the bed.

Another important notable difference is that in the prior art clamps or buttons or other fasteners must be removed when changing the sheets. In one or more preferred embodiments, the sleeve or band or sheet/bed cover securing device stays on the mattress and does need to be removed when changing the sheets.

PARTS LIST

The following is a list of parts and materials suitable for use in the present invention:

| Parts Number | Description |
|---|---|
| 10 | sleeve or band device/apparatus/system |
| 11 | mattress |
| 12 | securing, gripping, or positioning element |
| 13 | magnet/magnet material |
| 14 | sheet(s) |
| 15 | sleeve/band |
| 16 | bottom panel of sleeve/band |
| 17 | side panel of sleeve/band |
| 18 | side panel of sleeve/band |

-continued

| Parts Number | Description |
|---|---|
| 19 | end panel/head panel of sleeve/band |
| 20 | end panel/foot panel of sleeve/band |
| 21 | top portion/top edge of sleeve/band |
| 22 | periphery of sleeve/band |
| 23 | bottom/bottom portion of mattress |
| 24 | side wall/side portion of mattress |
| 25 | side wall/side portion of mattress |
| 26 | end wall/end portion of mattress/head |
| 27 | end wall/end portion of mattress/foot |
| 28 | top/top portion of mattress |
| 29 | cording |
| 30 | mid-point of mattress side portion |
| 31 | top edge of mattress |
| 32 | securing, gripping or positioning element/fastener |
| 33 | corner/corner portion/corner panel of sleeve/band |
| 34 | corner/corner portion of mattress |
| 35 | gripping/securing/strap element |
| 36 | bottom portion/bottom edge of sleeve/band |
| 37 | pocket |
| 38 | corner layer/corner securing layer/corner securing portion |
| 39 | double layer/two-ply layer/two-ply fabric |
| 40 | elastic layer |
| 41 | hook and loop straps/Velcro ® straps |
| 42 | hook and loop straps/Velcro ® straps |
| 43 | sleeve panel |
| 44 | panel layer/fabric/material |
| 45 | batting/filling |
| 46 | corner layer/fabric/material |
| 47 | grommet |
| 48 | mattress periphery |
| 49 | magnet system |
| 50 | bed |
| 55 | sleeve or band device/apparatus/system |
| 60 | sleeve or band device/apparatus/system |
| 61 | corner reinforcing piece/layer |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A band for securing one or more bed sheets on a mattress of a type that has a pair of mattress opposing sidewall surfaces and a pair of mattress opposing end wall surfaces, a mattress top surface, and a mattress periphery, the band comprising:

a) a plurality of panels including side panels, end panels, and corner panels, wherein the band has a top edge that is configured to align with or below the mattress top surface and wherein there is an open top surrounded by the top edge;

b) wherein each said corner panel joins with each said side panel and each said end panel;

c) wherein the band is configured to secure portions of the one or more bed sheets that rest upon and extend downwardly and on multiple of said mattress sidewall surfaces beyond the top surface of the mattress into a vertical space in between the band and the mattress sidewall and end wall surfaces when the band is positioned around the periphery of the mattress, and wherein the one or more bed sheets are not part of the band;

d) alternating of said panels having elastic or stretch force to hold the bed sheets in place on the mattress when said portions of the bed sheets are tucked into said vertical space in between the band and the mattress;

e) said alternating panels including a said panel that is less elastic and positioned in between two said panels that are more elastic; and f) wherein the band does not extend onto or cover the mattress top surface so that the band is not slept on, and wherein the bed sheets can be washed separately from the band.

2. The band of claim 1 wherein the elastic or stretch force is located at the corner panels.

3. The band of claim 2, wherein the elastic or stretch force is also located at the two opposing end panels.

4. The band of claim 2 wherein each said corner panel having elastic or stretch force further includes one or more additional overlapping layers of a securing, gripping, or positioning element provided on a top portion of each said corner panel and wherein each securing, gripping, or positioning element is placed along a mattress corner at a position below the mattress top surface, wherein said securing, gripping, or positioning elements and the elastic or stretch force are adapted to secure the bed sheets in place on the mattress when portions of the bed sheets that extend beyond the mattress top surface are secured in between the band and the mattress.

5. The band of claim 1, further comprising one or more magnets on the side panels of the band and one or more magnets on the sidewall surfaces of the mattress, and wherein the magnets on the side panels connect with the magnets on the sidewall surfaces of the mattress.

6. The band of claim 1, wherein the band includes one or more pockets having a vertical access opening.

7. The band of claim 4, wherein each said corner panel is about 2-16 inches long and the one or more additional overlapping layers of the securing, gripping, or positioning element extends about 3 inches from the top edge of said corner panel.

8. The band of claim 1, wherein the band eliminates a need for the bed sheets to be tucked under the mattress to be held in place.

9. A band for securing bed sheets on a mattress of a type that has a pair of mattress opposing sidewall surfaces and a pair of mattress opposing end wall surfaces, a mattress top surface, and a mattress periphery, the band comprising:

a) a pair of sidewall sections, a pair of end wall sections, and multiple corner sections, wherein the band has a top edge that is configured to align with or below the mattress top surface and wherein there is an open top surrounded by the top edge;

b) wherein the pair of sidewall sections are sized to be positioned along the pair of mattress opposing sidewall surfaces;

c) wherein said end wall sections are sized to be positioned along at least one of the mattress opposing end wall surfaces;

d) wherein the band is configured to hold a bed sheet that is separate from the band on the mattress top surface with portions of the bed sheet that rest upon and extend downwardly and on multiple of said mattress sidewall and end wall surfaces beyond the mattress top surface positioned into a vertical space in between the band and the mattress periphery;

e) said sidewall sections, said end wall sections and said corner sections providing alternating sections wherein some provide elastic or stretch force to hold the bed sheet in place on the mattress when the portions of the bed sheet that extend beyond the top mattress surface are positioned into said vertical space in between the band and the mattress sidewall and end wall surfaces;

f) said alternating sections including a said section that is less elastic positioned in between two said sections that are more elastic; and g) wherein the band does not extend onto or cover the mattress top surface so that the band is not slept on, and wherein the bed sheets can be washed separately from the band.

10. The band of claim 9, wherein the elastic or stretch force is located at one or more said corner sections.

11. The band of claim 9, wherein the elastic or stretch force is part of each sidewall section.

12. The band of claim 10, wherein the elastic or stretch force is also located at the pair of sidewalls.

13. The band of claim 10 wherein each corner section having elastic or stretch force further includes one or more additional overlapping layers of a securing, gripping, or positioning element provided on a top portion of each said corner section and wherein each securing, gripping, or positioning element is placed along a mattress corner at a position below the mattress top surface.

14. The band of claim 9, wherein the band includes one or more pockets having a vertical access opening.

15. The band of claim 9, wherein the band has a bottom edge that is positioned above a bottom of the mattress.

16. The band of claim 13, wherein each said corner section is about 2-16 inches long and the one or more additional overlapping layers of the securing, gripping, or positioning element extends about 3 inches from the top edge of said corner section.

17. The band of claim 9, wherein the band eliminates a need for the bed sheets to be tucked under a mattress to be held in place.

18. A band for holding bed sheets on a mattress of a type that has a mattress top surface, mattress sidewalls and a mattress periphery, the band comprising:

a) multiple band sections sized to be fitted along at least portions of the periphery of the mattress, wherein the band has a top edge that is configured to align with or below the mattress top surface and wherein there is an open top surrounded by the top edge;

b) the band configured to secure a sheet that is not part of the band and that is sized and shaped to rest upon and extend downwardly and on multiple of said mattress sidewalls beyond the mattress top surface when the sheet is placed on the mattress, said sheet positioned into a vertical space in between the band and the mattress periphery;

c) some but not all of said band sections having elastic or stretch force to hold the sheet in place on the mattress when the sheet extends beyond the top surface of the mattress and positioned into said vertical space in between the band and the mattress periphery; and d) said band sections being alternating sections wherein each section having elastic or stretch force is connected to two sections that do not have as much elasticity as said sections having elastic or stretch force; and e) wherein the band does not extend onto or cover the mattress top surface and wherein the bed sheets can be washed separately from the band.

19. The band of claim 18, wherein the band is connected to the mattress.

20. The band of claim 18, wherein the band is removably securable to the mattress.

21. The band of claim 18, wherein the elastic or stretch force sections are located at corners.

22. The band of claim 18, wherein the elastic or stretch force sections are located at sides of the band.

23. The band of claim 18, wherein the elastic or stretch force sections are located at opposing ends of the band.

24. A band for securing one or more bed sheets on a mattress of a type that has a pair of mattress opposing sidewall surfaces and a pair of mattress opposing end wall surfaces, a mattress top surface, a mattress bottom and a mattress periphery, the band comprising:

a) a plurality of band panels including side panels, end panels, and corner panels, and a top edge that is configured to align with or below the mattress top surface and wherein there is an open top surrounded by the top edge;

b) said corner panels having elastic or stretch force, and wherein said side panels and end panels are less elastic than the corner panels;

c) wherein each said corner panel joins with one of said side panels and one of said end panels;

d) wherein the band is configured to hold a bed sheet, which is separate from the band, wherein the bed sheet rests upon and extends downwardly and on multiple of said mattress sidewall and end wall surfaces beyond the mattress top surface and can be positioned into a vertical space in between the band and the mattress sidewall and end wall surfaces when the band is positioned around the mattress periphery;

e) wherein each said corner panel top portion includes two or more overlapping layers having elastic or stretch force;

e) wherein the band does not extend onto or cover the mattress top surface so that the band is not slept on, and wherein the bed sheets can be washed separately from the band; and f) wherein the band eliminates a need for the bed sheets to be tucked under the mattress bottom to be held in place.

25. The band of claim 24, wherein the band has a bottom edge that is positioned under the mattress bottom.

* * * * *